US010254691B2

(12) United States Patent
Hirose et al.

(10) Patent No.: US 10,254,691 B2
(45) Date of Patent: Apr. 9, 2019

(54) FIXING DEVICE THAT REGULATES A POSITION OF AN INNER SURFACE OF A FILM

(71) Applicant: CANON KABUSHIKI KAISHA, Tokyo (JP)

(72) Inventors: Masaki Hirose, Suntou-gun (JP); Satoru Taniguchi, Mishima (JP); Takashi Honke, Mishima (JP); Hirohiko Aiba, Suntou-gun (JP); Keita Nakajima, Mishima (JP); Kazushi Nishikata, Tokyo (JP); Fumiki Inui, Mishima (JP); Koichi Yamada, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/869,197

(22) Filed: Jan. 12, 2018

(65) Prior Publication Data

US 2018/0203386 A1 Jul. 19, 2018

(30) Foreign Application Priority Data

Jan. 13, 2017 (JP) ..... 2017-003825
Dec. 11, 2017 (JP) ..... 2017-236983

(51) Int. Cl.
*G03G 15/20* (2006.01)

(52) U.S. Cl.
CPC . *G03G 15/2053* (2013.01); *G03G 2215/0132* (2013.01); *G03G 2215/2035* (2013.01)

(58) Field of Classification Search
CPC ..... G03G 15/2053; G03G 2215/0132; G03G 2215/2035; G03G 15/206
See application file for complete search history.

(56) References Cited

U.S. PATENT DOCUMENTS 5,752,149 A * 5/1998 Yuza ..... G03G 15/2064 399/329
8,611,802 B2 12/2013 Suzuki et al.
9,268,270 B2 2/2016 Hashiguchi et al.
2006/0233575 A1* 10/2006 Uchida ..... G03G 15/2053 399/329

(Continued)

FOREIGN PATENT DOCUMENTS

JP 2002-246151 A 8/2002
JP 2011-180227 A 9/2011
JP 2014-115512 A 6/2014

*Primary Examiner* — Francis C Gray
(74) *Attorney, Agent, or Firm* — Venable LLP

(57) ABSTRACT

A fixing device includes a rotatable cylindrical film, a contact member, a nip forming member, and regulating member. The regulating member includes an inner surface regulating surface that contacts and regulates a position of an inner surface of the film, and that, with respect to a rotational direction of the film, includes a first region remotest from a nip and a second region closer to the nip than the first region, the second region being positioned in a side upstream of a center of the nip with respect to a recording material feeding direction. The inner surface regulating surface is inclined so as to be spaced from the inner surface of the film toward a longitudinal center of the film, and a degree of inclination of the inner surface regulating surface is greater in the first region than in the second region.

15 Claims, 17 Drawing Sheets

(56) References Cited

U.S. PATENT DOCUMENTS

| | | | | |
|---|---|---|---|---|
| 2011/0211882 | A1* | 9/2011 | Suzuki | G03G 15/2053 399/329 |
| 2012/0148303 | A1* | 6/2012 | Yamaguchi | G03G 15/2053 399/122 |
| 2012/0163882 | A1* | 6/2012 | Kim | G03G 15/2025 399/328 |
| 2013/0039683 | A1* | 2/2013 | Fujita | G03G 15/2053 399/329 |
| 2015/0316875 | A1* | 11/2015 | Ueda | G03G 15/2053 399/330 |

* cited by examiner

FIXING DEVICE THAT REGULATES A POSITION OF AN INNER SURFACE OF A FILM

This application claims the benefit of Japanese Patent Applications Nos. 2017-003825 filed on Jan. 13, 2017, and 2017-236983 filed on Dec. 11, 2017, which are hereby incorporated by reference herein in their entireties.

FIELD OF THE INVENTION AND RELATED ART

The present invention relates to a fixing device (image heating device) mounted in an image forming apparatus, such as a copying machine, a printer, a facsimile machine, or a multi-function machine having a plurality of functions of these machines.

As the fixing device (image heating device) mounted in the image forming apparatus, a fixing device of a film (belt) heating type has been known. Specifically, to a rotatable member (first rotatable member) such as a flexible cylindrical fixing film incorporating a ceramic heater, a pressing roller (second rotatable member) is press-contacted, so that a nip is formed between the both (first and second) rotatable members. A recording material (medium) carrying an unfixed image is inserted and passed through the nip, so that the unfixed image is heated and pressed. As a result, the unfixed image is fixed on the surface of the recording material.

In the device of this film heating type, there is a need to prevent (to regulate) shift motion of the fixing film during rotation of the film, i.e., movement of the film in a thrust direction. As one of preventing (regulating) means, a film holding member (hereinafter, referred to as a flange) for receiving a film end portion and for preventing the movement of the film is provided on both end sides or on one end side of the film.

In addition to the above-described function, the flange includes a film inner surface regulating surface and has a function of regulating a rotation traveling shape of the film. By forming the inner surface regulating surface in a shape that is close to a natural rotation shape of the film, such as an elliptical shape elongated in an upstream-downstream direction with respect to a recording material feeding direction, a fatigue phenomenon, such as film breakage, is not readily generated. On the other hand, in the case in which an inner diameter of the film is smaller, or in the case in which an incorporated member in the film is large, in order to prevent contact with the incorporated member, in some cases, the film shape is regulated to a shape close to a true (perfect) circle by hoisting (raising) the film from the natural rotation shape.

In this state, when the film is rotationally driven, the film and the flange continuously rub against each other strongly at the hoisted portion. As a result, an inner peripheral surface of the film and the inner surface regulating surface of the flange are liable to abrade or to deteriorate, and finally, a film end portion tears and becomes unusable. Further, in the case in which the film rotates at a higher speed with speed-up of the image forming apparatus, this phenomenon is exacerbated. As a result, in the device of the film heating type, when downsizing and speed-up of the device are intended to be realized, the abrasion (wearing) of the film formed a bottleneck.

Japanese Laid-Open Patent Application (JP-A) 2002-246151 discloses that an inner surface regulating surface of a flange is formed of a natural material containing no glass fibers. As a result, compared with a resin material containing glass fibers, smoothness and surface roughness are improved, and a sliding property is improved, so that damage on the film decreases and the improvements can contribute to lifetime extension of the film. Such a constitution is proposed. Specifically, the flange is formed of the natural material at a surface portion contacting the film and is formed of the resin material containing the glass fibers at a base material portion other than the surface portion, and then these portions are connected with each other so as to function as the flange. By this two-component part constitution, two purposes of alleviating the damage on the film and of reinforcing mechanical strength of the flange itself are achieved.

In a case in which the constitution of JP-A 2002-246151 is employed, however, there arises a problem such that a cost increases due to the two-component part constitution.

SUMMARY OF THE INVENTION

According to one aspect, the present invention provides a fixing device comprising a cylindrical film, a contact member contacting an inner surface of the film, a nip forming member configured to form a nip in cooperation with the contact member through the film, wherein, in the nip, a recording material on which an image is formed is heated while being fed, and the image is fixed on the recording material, and a regulating member provided at a longitudinal end portion of the film and including an inner surface regulating surface that opposes the inner surface of the film and that is configured to regulate a position of the inner surface of the film, wherein, as viewed in a longitudinal direction of the film, with respect to a rotational direction of the film, the inner surface regulating surface includes a first region remotest from the nip and a second region closer to the nip than the first region, and wherein the inner surface regulating surface is inclined so as to be spaced from the inner surface of the film toward a longitudinal center of the film with respect to the longitudinal direction of the film, and a degree of inclination of the inner surface regulating surface is greater in the first region than in the second region.

According to another aspect, the present invention provides a fixing device comprising a cylindrical film a contact member contacting an inner surface of the film a nip forming member configured to form a nip in cooperation with the contact member through the film, wherein, in the nip, a recording material on which an image is formed is heated while being fed, and the image is fixed on the recording material, and a regulating member provided at a longitudinal end portion of the film and including an inner surface regulating surface that opposes the inner surface of the film and that is configured to regulate a position of the inner surface of the film, wherein, as viewed in a longitudinal direction of the film, with respect to a rotational direction of the film, the inner surface regulating surface includes a first region remotest from the nip and a second region closer to the nip than the first region, and wherein the first region of the inner surface regulating surface is inclined so as to be spaced from the inner surface of the film toward a longitudinal center of the film with respect to the longitudinal direction of the film, and in the second region of the inner surface regulating surface, a distance from the inner surface of the film is the same over the longitudinal direction of the film.

Further features of the present invention will become apparent from the following description of exemplary embodiments with reference to the attached drawings.

BRIEF DESCRIPTION OF THE DRAWINGS

Parts (a) and (b) of FIG. 1 are schematic views for illustrating a shape of a flange.

Figure 6:
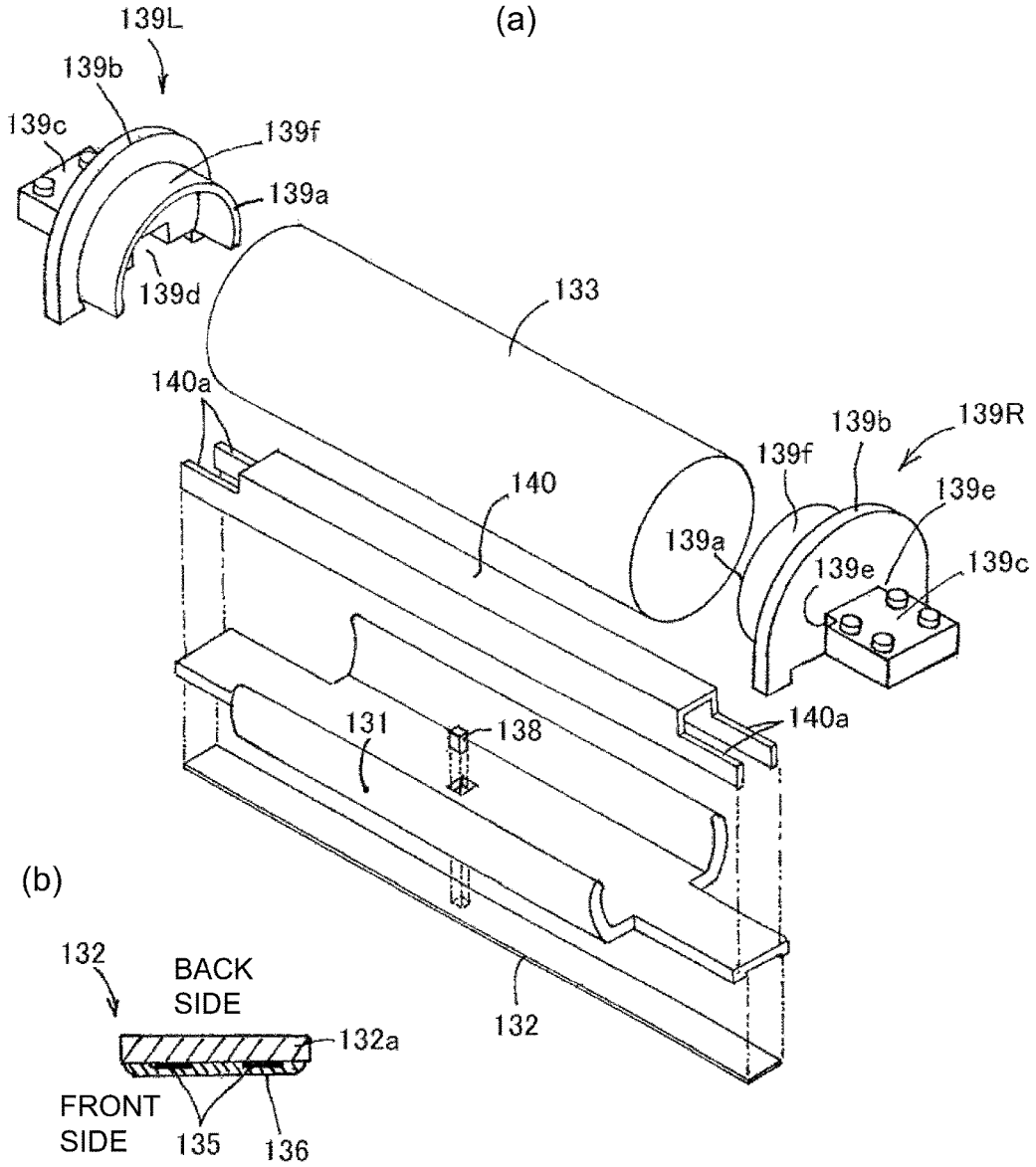

Part (a) of FIG. 6 is a schematic exploded perspective view of a film unit, and part (b) of FIG. 6 is a schematic cross-sectional view of a heater.

Figure 7:
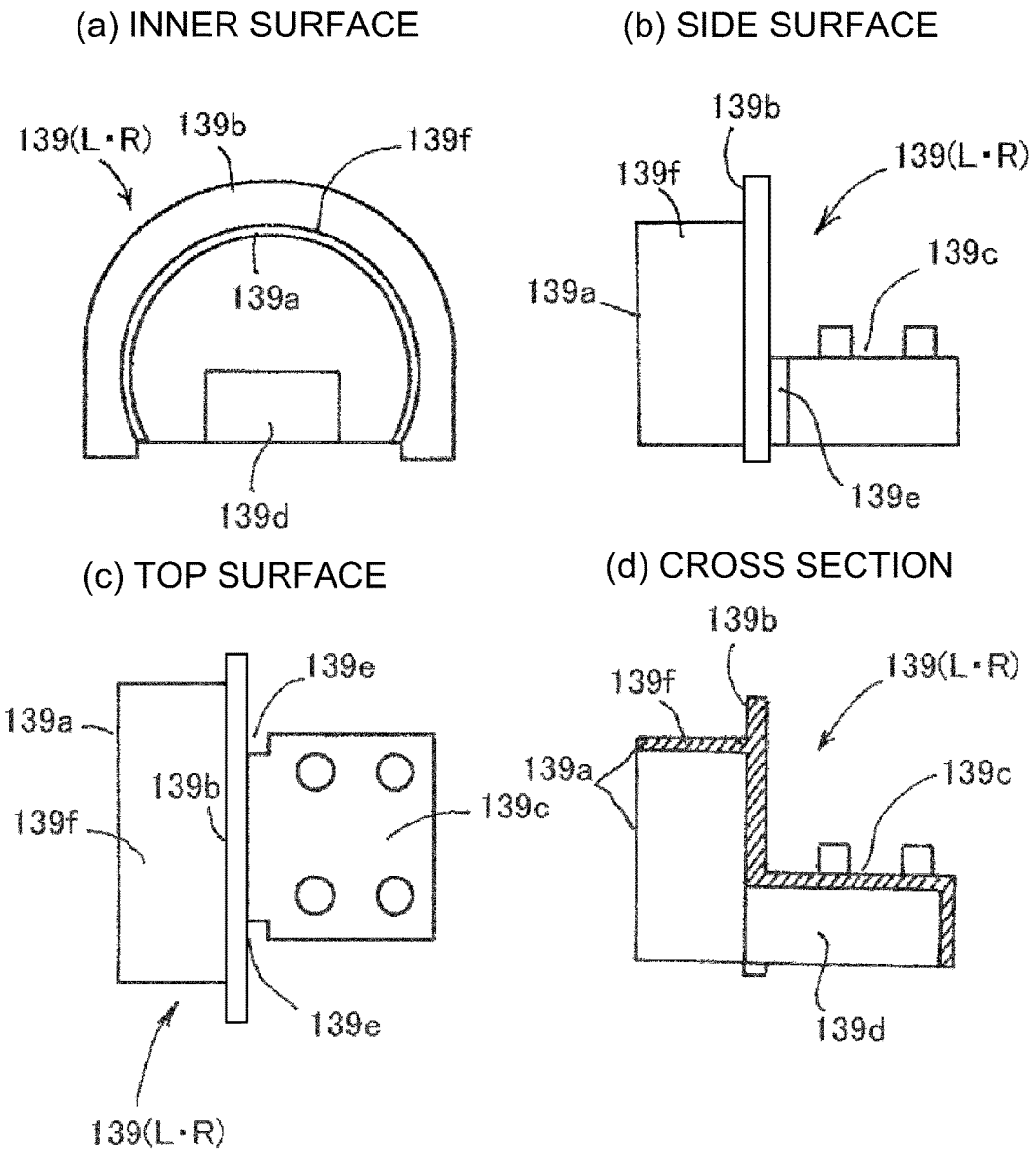

Parts (a) to (d) of FIG. 7 are schematic views for illustrating a structure of the flange.

Figure 8:
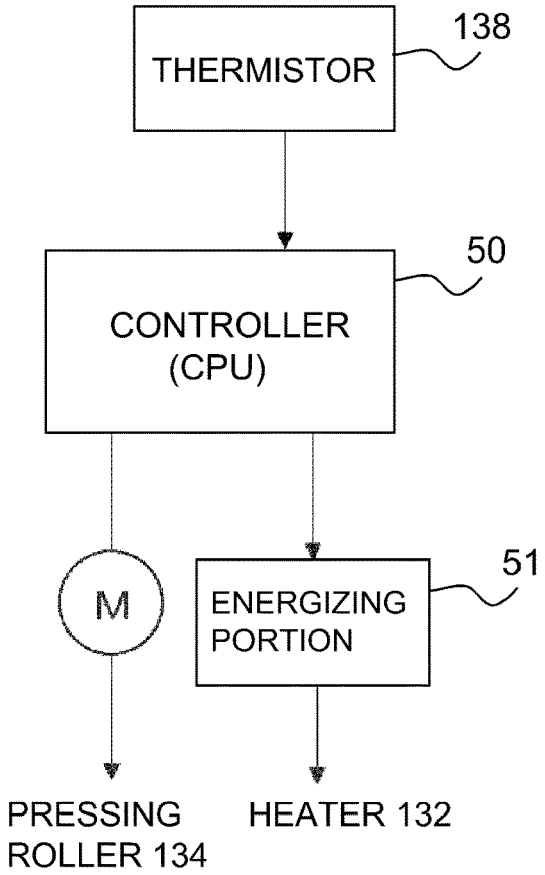

FIG. 8 is a block diagram of a control system.

Figure 9:
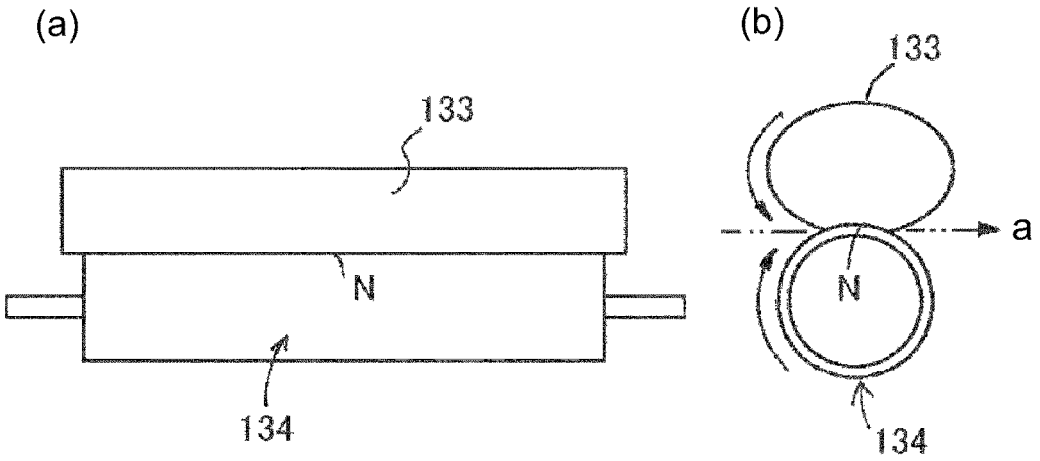

Parts (a) and (b) of FIG. 9 are schematic views for illustrating a rotational locus of a film.

Figure 10:
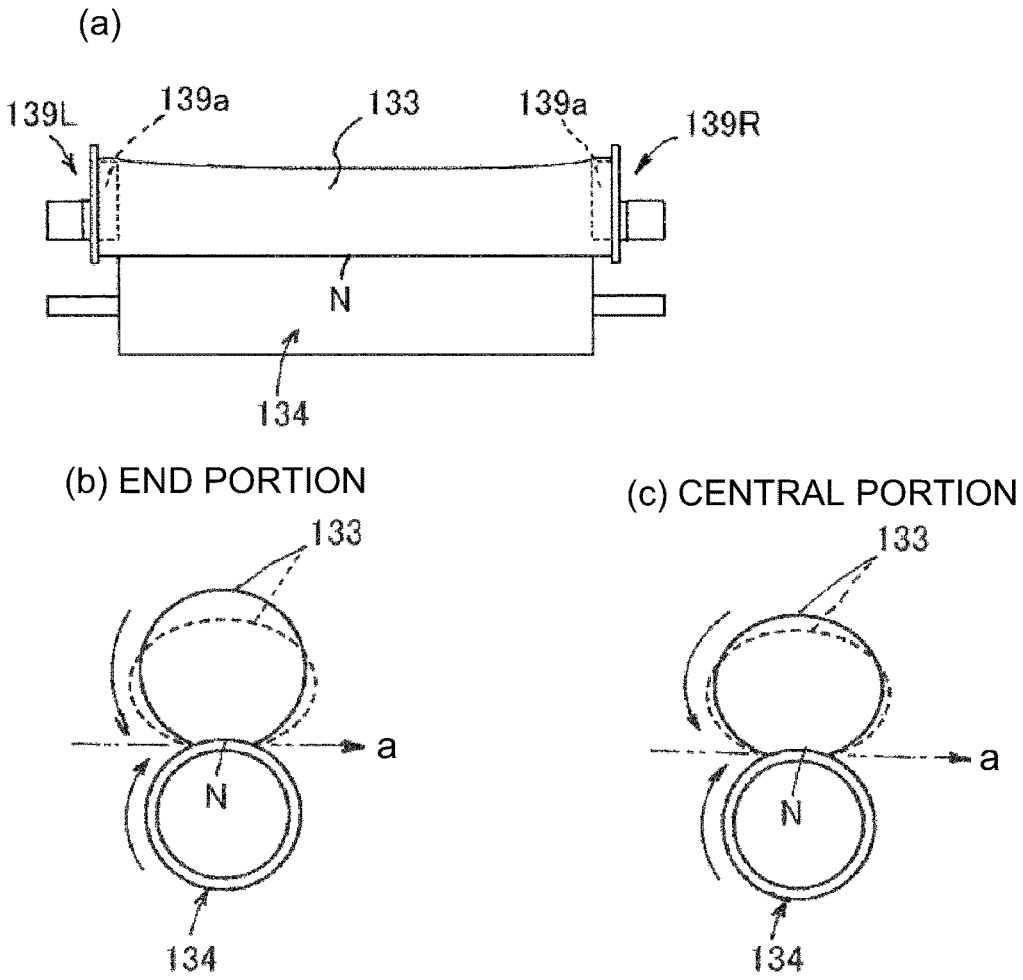

Parts (a) to (c) of FIG. 10 are schematic views for illustrating a rotational locus of a film.

Figure 11:
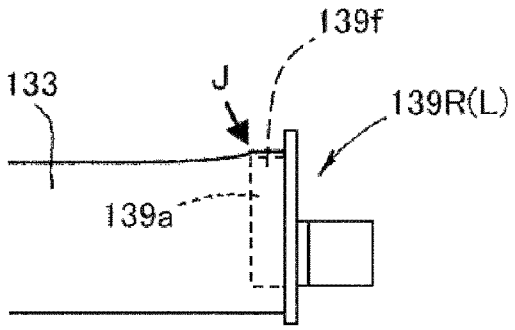

FIG. 11 is a schematic view for illustrating an arrangement of the film and the flange.

Figure 12:
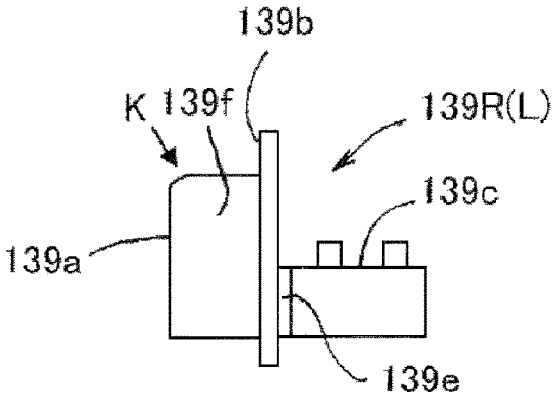

FIG. 12 is a schematic view for illustrating a shape of the flange.

Figure 13:
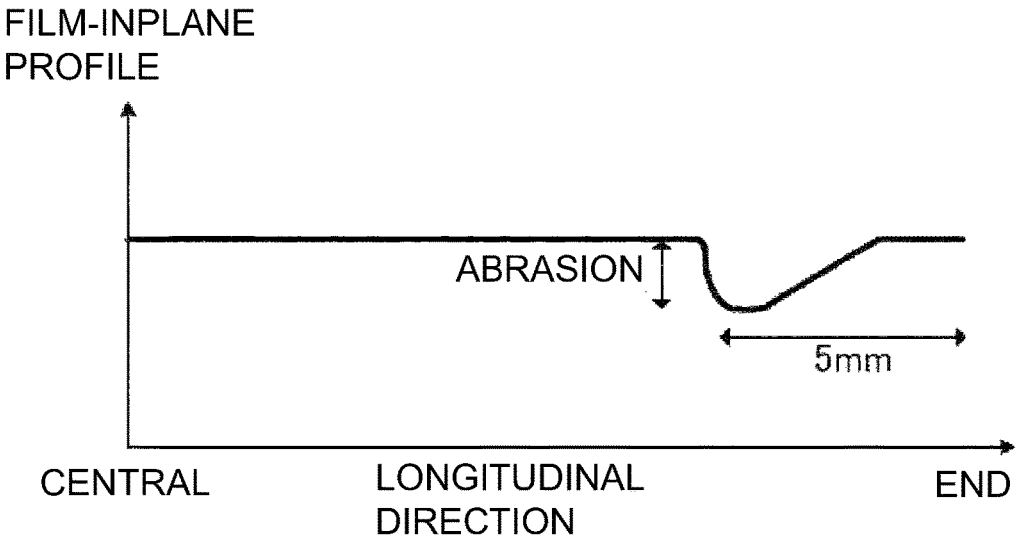

FIG. 13 is a schematic view for illustrating a profile of a film inner surface.

Figure 14:
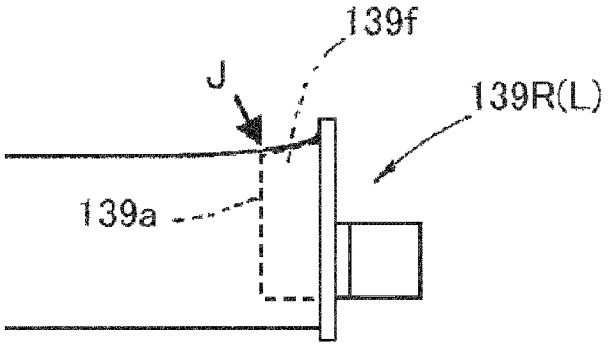

FIG. 14 is a schematic view for illustrating an arrangement of the film and the flange.

Figure 15:
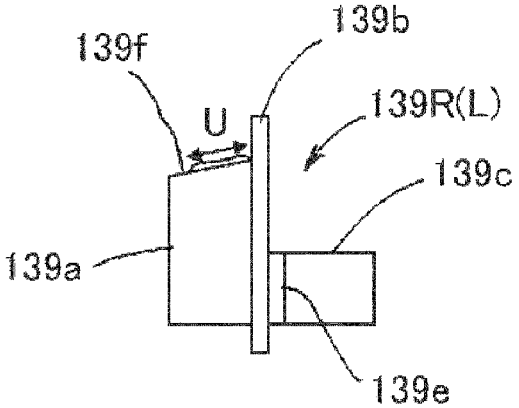

FIG. 15 is a schematic view for illustrating a shape of the flange.

Figure 16:
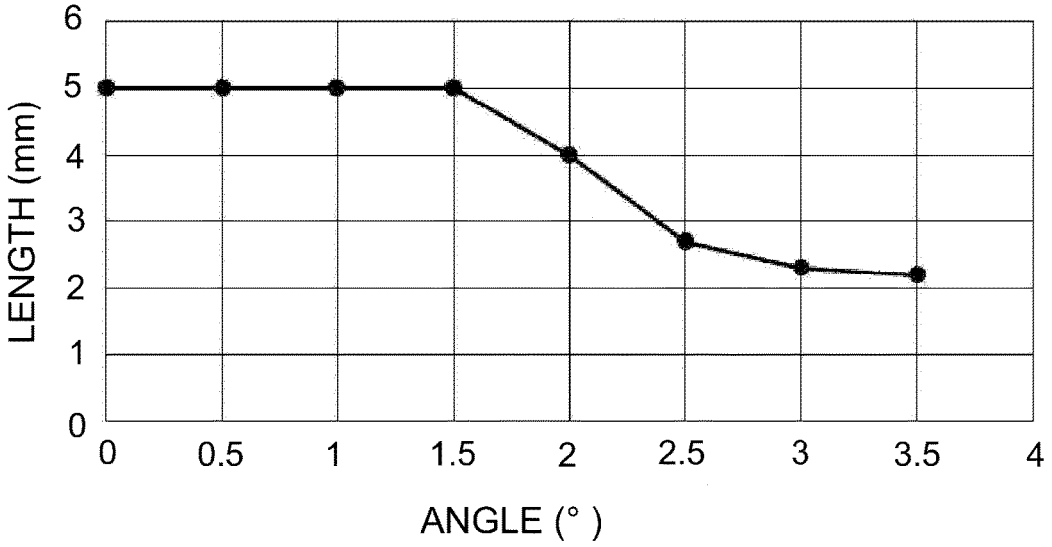

FIG. 16 is a graph for illustrating a contact region of the flange.

Figure 17:
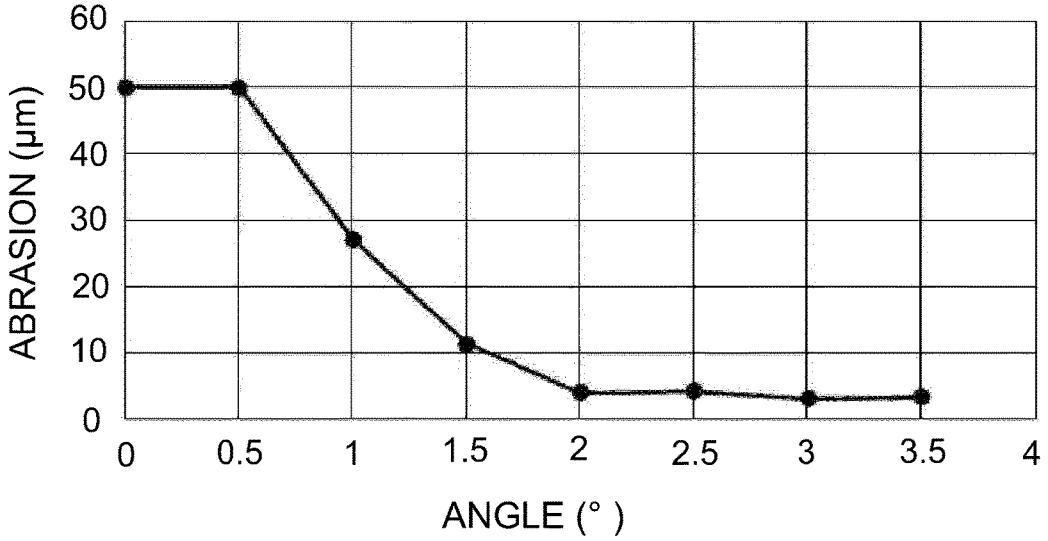

FIG. 17 is a graph for illustrating abrasion (wearing) of the film inner surface.

Figure 18:
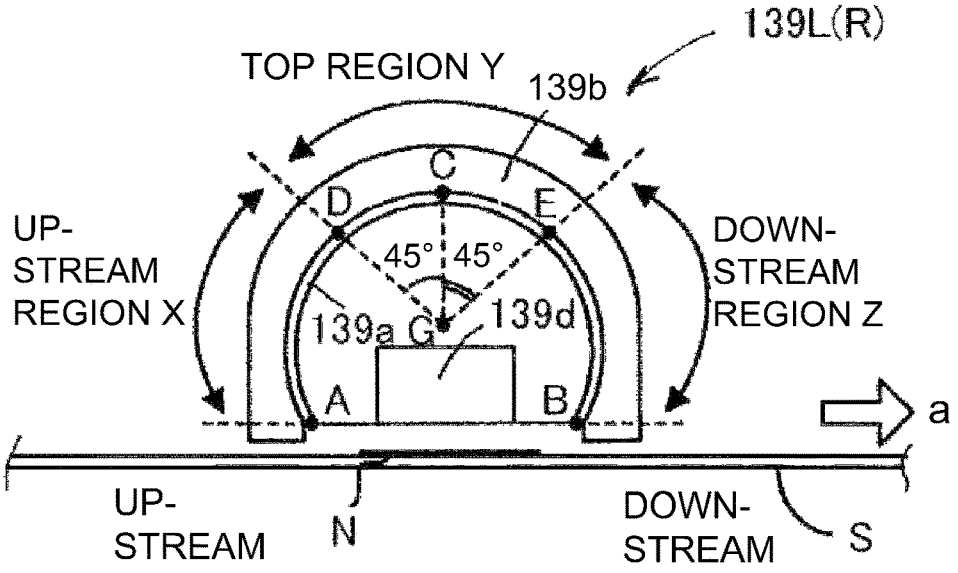

FIG. 18 is a schematic view for illustrating the shape of the flange.

Figure 19:
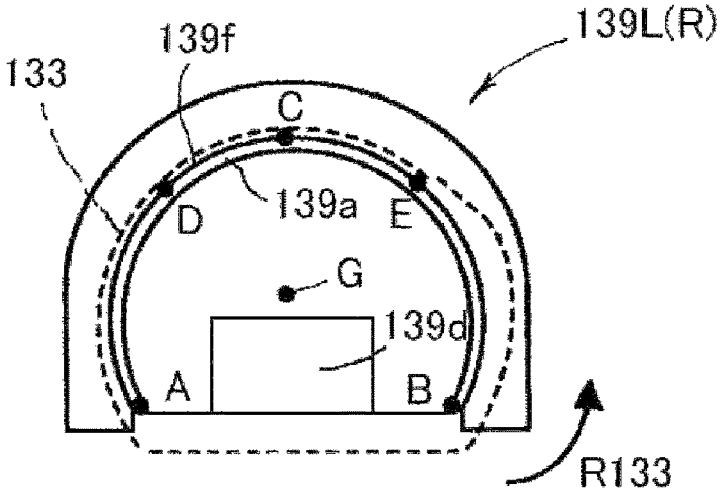

FIG. 19 is a schematic view for illustrating an arrangement of the film and the flange.

Figure 20:
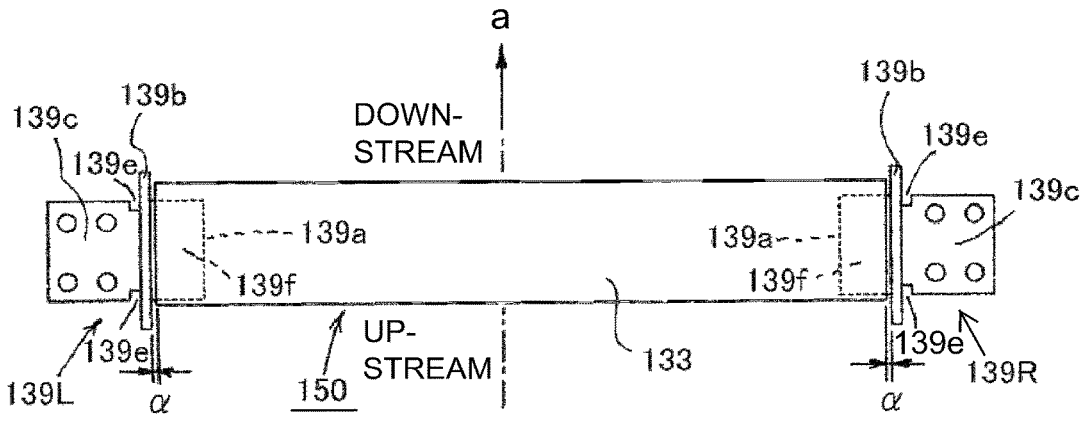

FIG. 20 is a schematic view for illustrating an arrangement of the film and the flange.

Figure 21:
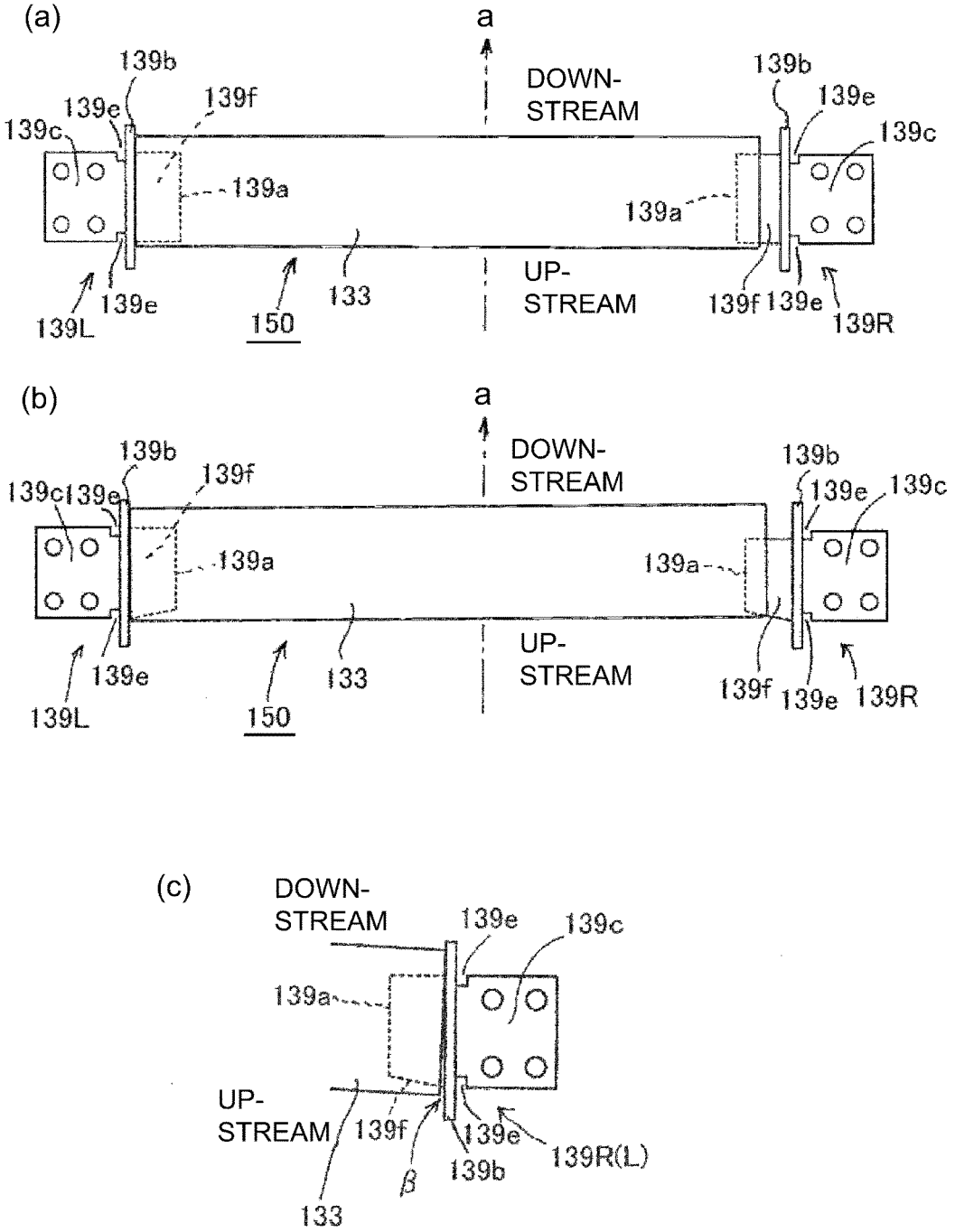

Parts (a) to (c) of FIG. 21 are schematic views for illustrating an arrangement of the film and the flange.

Figure 22:
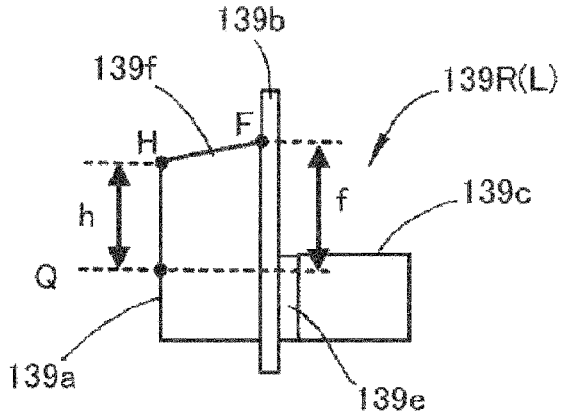

FIG. 22 is a schematic view for illustrating a shape of the flange.

Figure 23:
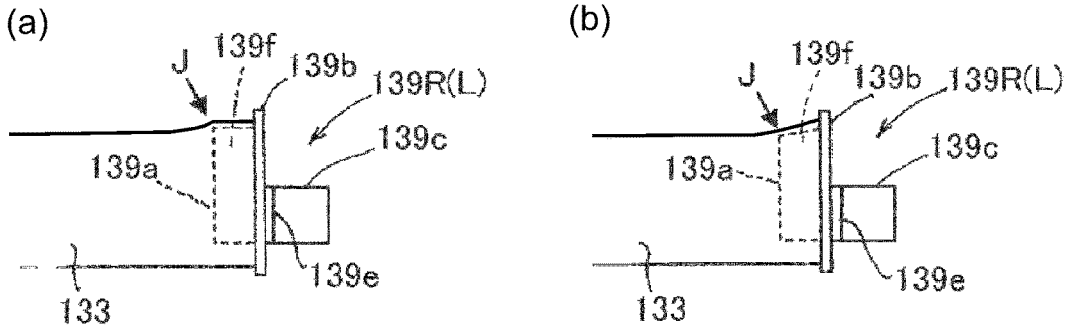

Parts (a) and (b) of FIG. 23 are schematic views for illustrating an arrangement of a film and a flange.

Figure 24:
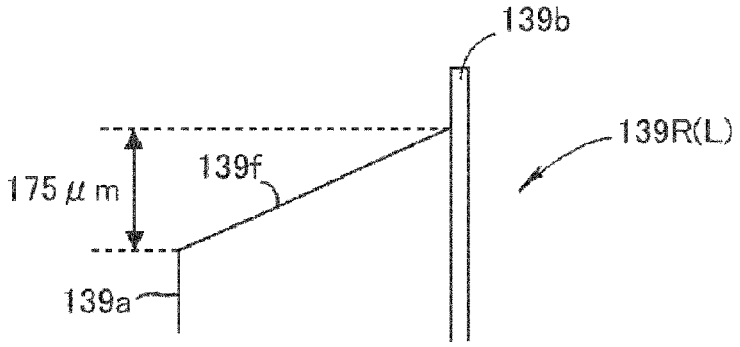

FIG. 24 is a schematic view for illustrating a shape of the flange.

Figure 25:
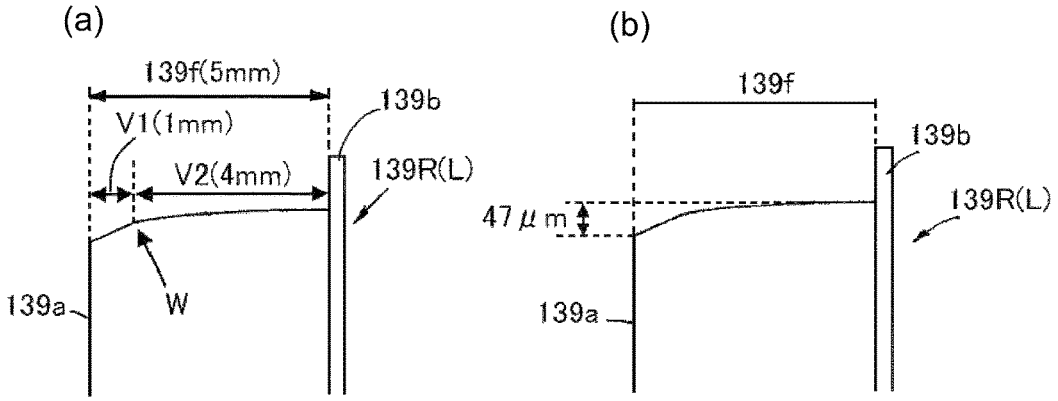

Parts (a) and (b) of FIG. 25 are schematic views for illustrating a shape of the flange.

Figure 26:
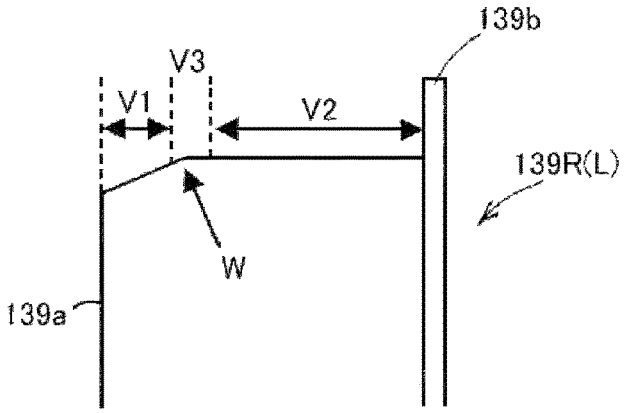

FIG. 26 is a schematic view for illustrating a shape of the flange.

Figure 27:
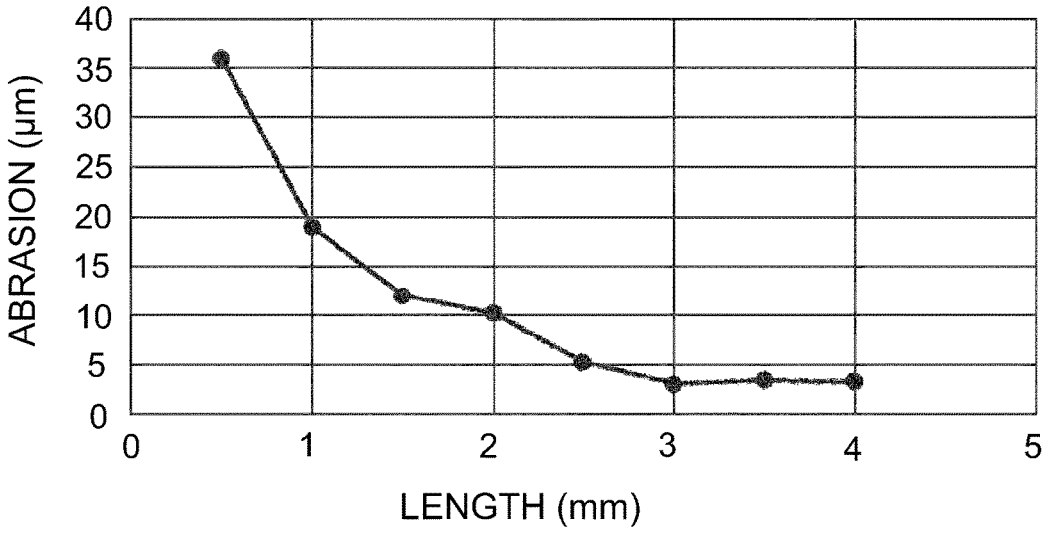

FIG. 27 is a graph for illustrating abrasion of a film inner surface.

DESCRIPTION OF EMBODIMENTS

Embodiments of the present invention will be specifically described with reference to the drawings. Dimensions, materials, shapes, and relative arrangements of constituent elements described in the following embodiments should be appropriately changed depending on structures and various conditions of mechanisms (apparatuses) to which the present invention is applied. Accordingly, the scope of the present invention is not intended to be limited to the following embodiments.

Embodiment 1

[Image Forming Apparatus]

Figure 2:
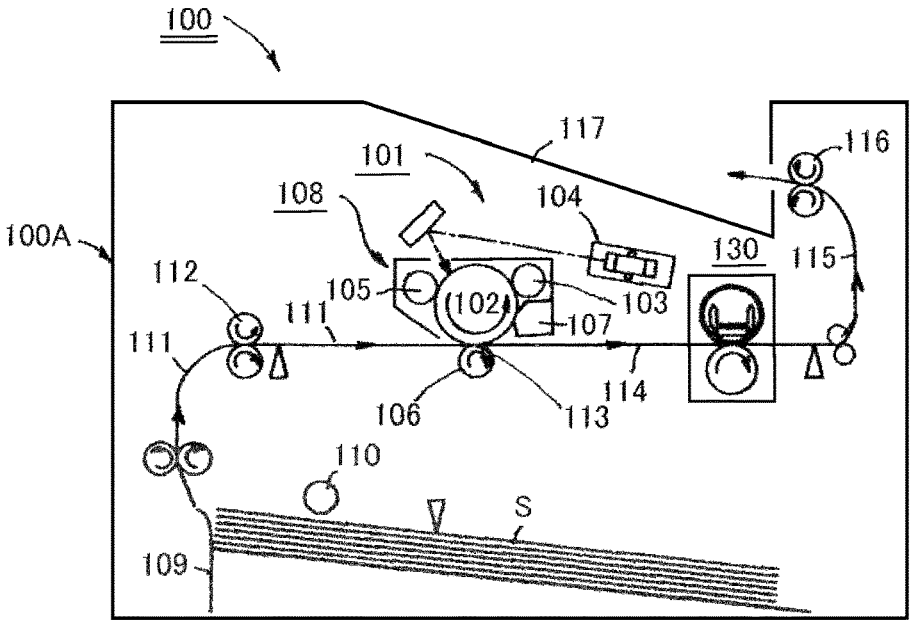
FIG. 2 is a schematic structural view of an example of an image forming apparatus.

FIG. 2 is a schematic view showing a general structure of an example of an image forming apparatus 100 in which an image heating apparatus is mounted as a fixing device 130 according to the present invention. The image forming apparatus 100 is a monochromatic printer using an electrophotographic process.

In the image forming apparatus 100, an image forming portion 101 for forming a toner image on a recording material (hereinafter, referred to as a sheet or paper) S includes a photosensitive drum (hereinafter, referred to as a drum) 102 as an image bearing member, and a charging member 103 for electrically charging a surface of the drum 102. The image forming portion 101 further includes a laser scanner 104 for subjecting the charged surface of the drum 102 to image exposure, a developing device 105 for developing, with toner, an electrostatic latent image formed on the drum surface, a transfer member 106, and a drum cleaner 107.

The drum 102, the charging member 103, the developing device 105, and the drum cleaner 107 are integrally constituted as a process cartridge 108 detachably mountable to an apparatus main assembly 100A. An image forming operation (electrophotographic process) of the image forming portion 101 is well known and will be omitted from detailed description. As regards specifications of the image forming apparatus 100 used in this embodiment, a process speed is 350 mm/sec.

Sheets S accommodated in a cassette 109 in the apparatus main assembly 100A are fed one by one by rotation of a sheet (paper) feeding roller 110. Then, the sheet S is introduced at predetermined control timing to a transfer nip 113 formed by the drum 102 and the transfer member 106 along a feeding path 111, including a registration roller pair 112, and is subjected to transfer of the toner image formed on the drum 1 side. The sheet S coming out of the transfer nip 113 is sent to a fixing device (fixing portion) 130 along a feeding path 114, and is subjected to a heat pressure fixing process of the toner image. The sheet S coming out of the fixing device 130 passes through a feeding path 115, and is discharged as an image-formed product onto a tray 117 by a discharging roller 116.

[Fixing Device]

As regards the fixing device 130, a front surface (side) is an entrance side of the sheet S, and a rear (back) surface (side) is an exit side of the sheet S. Left and right refer to left (one end side) and right (the other end side), respectively, when the fixing device 130 is seen from the front side. Upper (up) and lower (down) refer to those with respect to a direction of gravitation. Upstream side and downstream side refer to those with respect to a sheet feeding direction (recording material feeding direction). Further, an axial direction of a pressing roller or a direction parallel to the axial direction is a longitudinal direction, and a direction perpendicular to the longitudinal direction is a widthwise direction.

Figure 3:
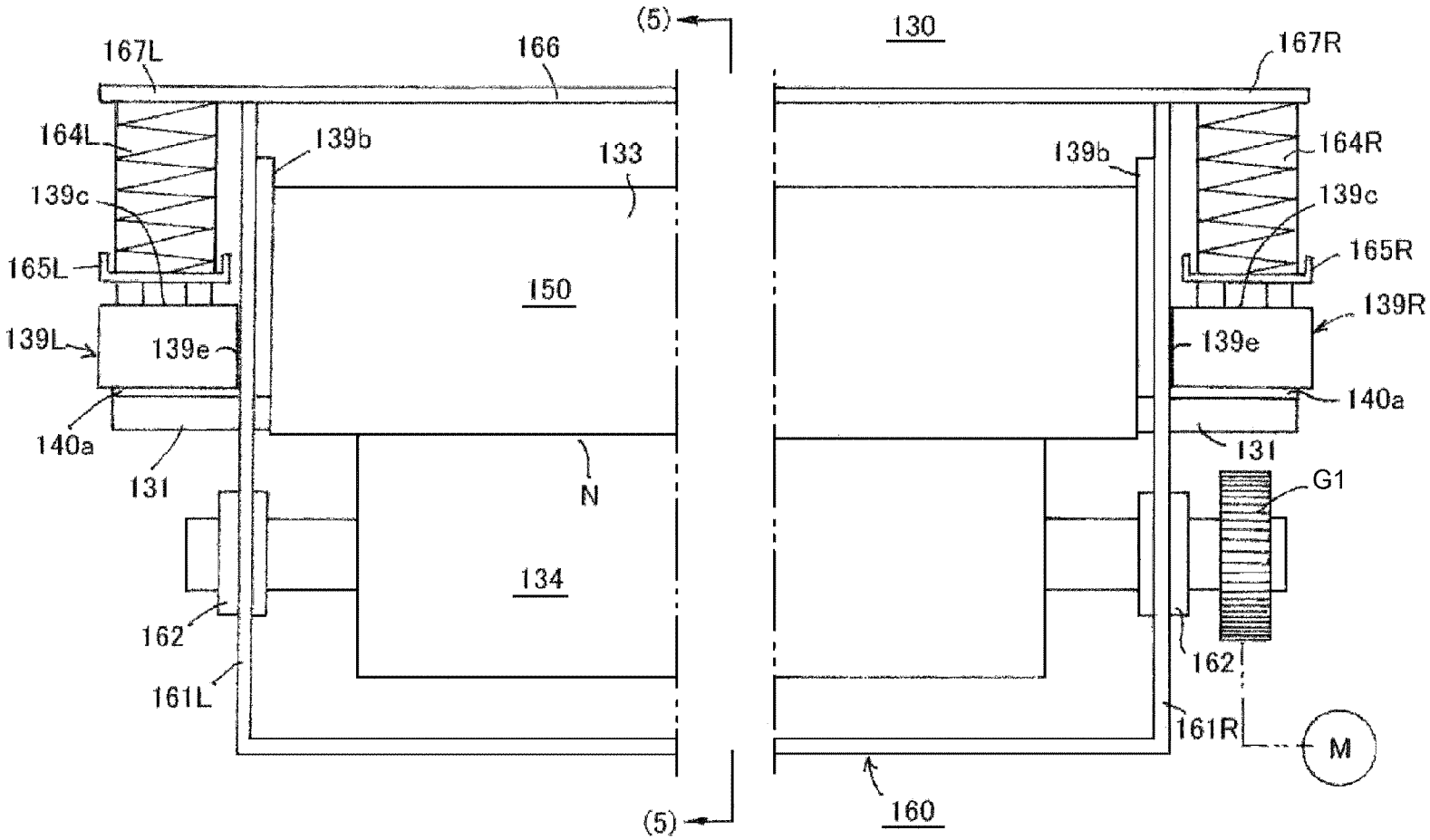
FIG. 3 is a schematic front view of an example of a fixing device from which an intermediary portion is omitted.
Figure 4:
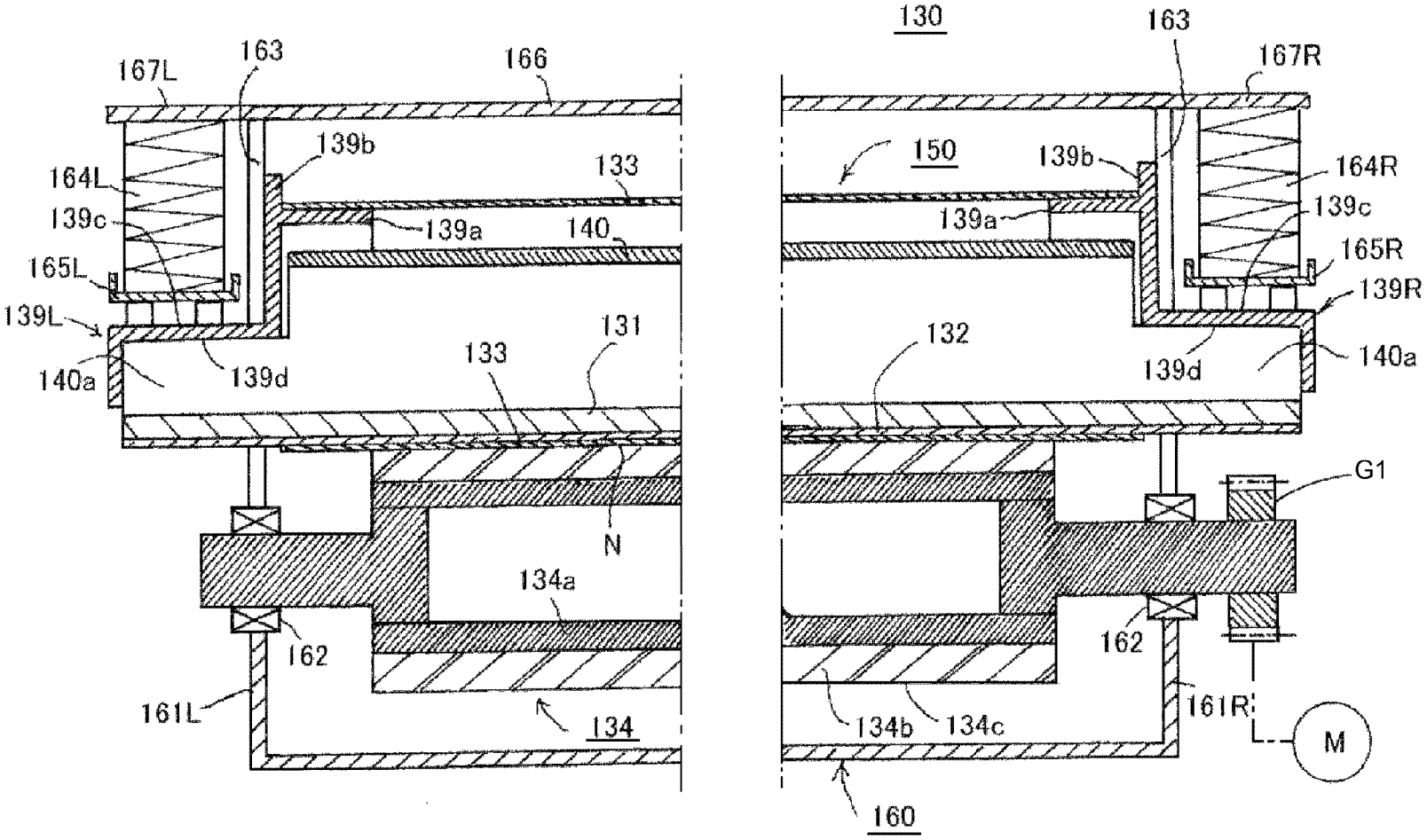
FIG. 4 is a schematic longitudinal front view of the fixing device from which an intermediary portion is omitted.
Figure 5:
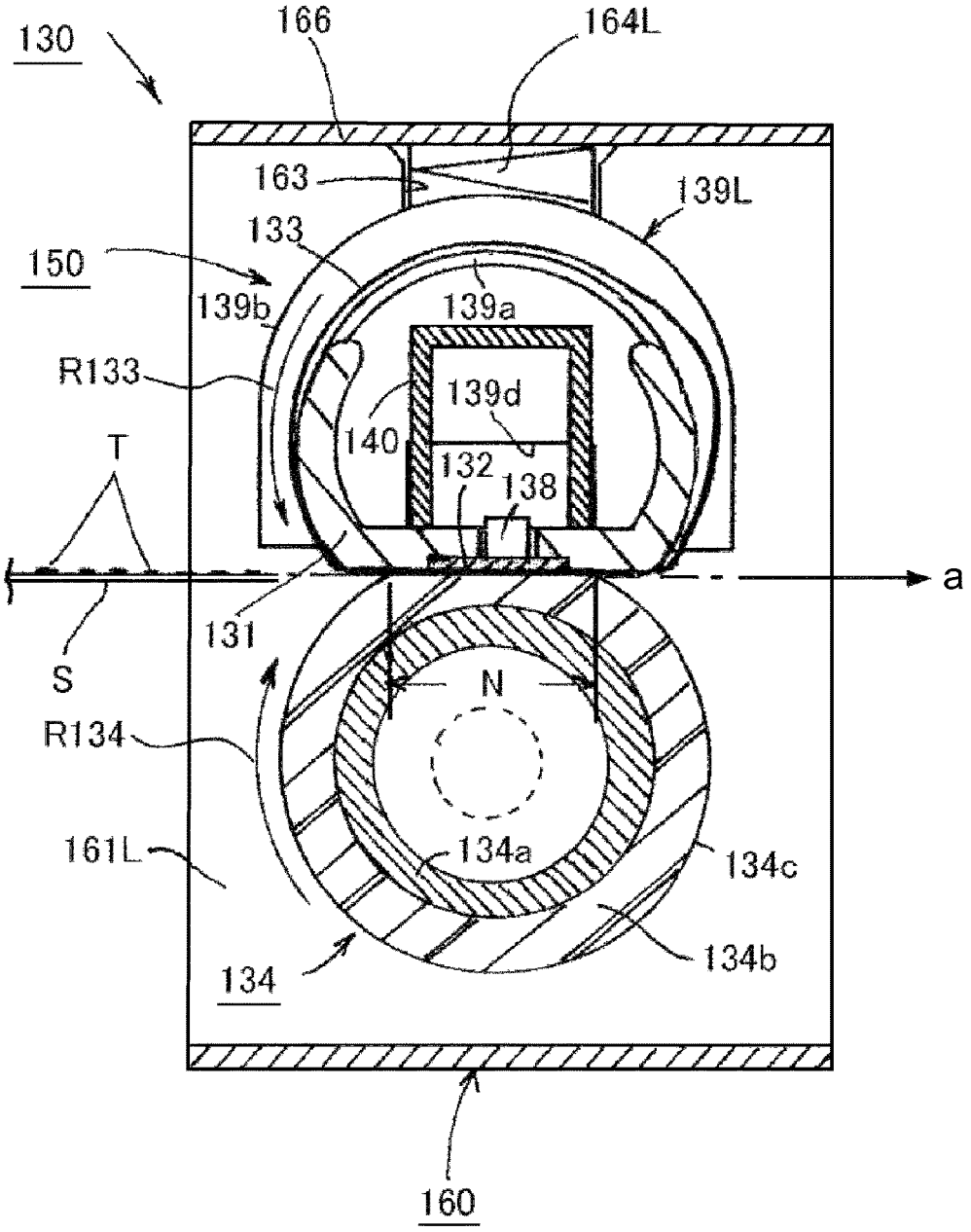
FIG. 5 is a schematic cross-sectional right side view of the fixing device.

The fixing device 130 is an image heating device (OMF: on-demand fixing device) of a film (belt) heating type enabling shortening of a rise time and low power consumption. FIG. 3 is a schematic front view of the fixing device 130, and FIG. 4 is a schematic longitudinal front view of the fixing device 130. FIG. 5 is a schematic cross-sectional right side view of the fixing device 130 taken along section line (5)-(5) line of FIG. 3. The fixing device 130 roughly includes a film unit (belt unit) 150, an elastic pressing roller (rotatable driving member) 134 as a pressing member, and a device frame (casing) 160 accommodating these members.

(1) Film Unit 150

Part (a) of FIG. 6 is a schematic exploded perspective view of the film unit 150. The film unit 150 includes a fixing film (fixing belt, hereinafter referred to as a film) 133 that is loosely fitted around an inner assembly (incorporated member, internal member) and that is a flexible and cylindrical (endless) first rotatable member. Inside the film 133, a heater 132 as a heating member, a guiding member (holding member) 131 that holds the heater 132 and that guides rotation of the film 133, and a rigid pressing stay 140 formed of, e.g., iron, for holding the guiding member 131, are provided as the inner assembly. The heater 132 is a contact member contacting an inner surface of the film 133.

Each of the heater 132, the guiding member 131, and the stay 140 is an elongated member having a length greater than a width (length) of the film 133, and extends outwardly from each of ends of the film 133 on an associated side, i.e., on one end side (left side) or the other end side (right side). Further, flanges (film holding members, preventing (regulating) members) 139(L,R) on one end side and the other end side of the stay 140 are engaged with outwardly projected portions 140*a* of the stay 140 on one end side and the other end side, respectively. That is, at end portions of the film 133 with respect to the longitudinal direction, the flanges 139 (L,R) are disposed.

(1-1) Film 133

The flexible cylindrical film 133 is provided so that an inner positional length thereof is greater than an outer peripheral length of the guiding member 131 supporting the heater 132. Accordingly, the film 133 is externally fitted around the guiding member 131 with allowance in peripheral length. In this embodiment, the film 133 having an inner diameter of 24 mm is used.

As regards the film 133, in order to efficiently impart heat of the heater 132 to the sheet S as a material-to-be-heated in the nip N formed in cooperation with the pressing roller 134, a single-layer film having a film layer thickness of 20 to 70 μm and that is formed of a heat-resistant material, such as PTFE, PFA, or FEP, can be used. Alternatively, a composite layer film can be used.

As the composite layer film, a film having a three-layer structure generally consisting of a base layer, an elastic layer formed on an outer peripheral surface of the base layer, for the purpose of improving a fixing property, and a parting layer formed at an outermost surface of the film, is used. The base layer is formed of, e.g., polyimide, polyamideimide, PEEK, PES, PPS, or SUS, or the like. The electric layer is formed of, e.g., a material obtained by mixing a heat conductive filler, such as ZnO, $Al_2O_3$, SiC, or metal silicon, or the like, into an elastic material, such as a silicone rubber. The parting layer is coating layer formed of, e.g., PTFE, PFA or FEP, or the like.

In this embodiment, as the base layer, a 50 μm-thick layer of polyimide to which electroconductivity was imparted by mixing a filler therein was used. As the elastic layer, a 240 μm-thick silicone rubber-heat conductive filler mixture layer was used. As the parting layer, an outermost surface coating layer of PTFE was used.

Here, PTFE is polytetrafluoroethylene. PFA is tetrafluoroethylene-perfluoroalkylvinyl ether copolymer. FEP is tetrafluoroethylene-hexafluoropropylene copolymer. FEP is polyether sulfone.

(1-2) Heater 132

As the heater 132 as a nip forming member, a ceramic heater is used in general. As a heater substrate, a ceramic substrate that is formed of ceramics, such as alumina or aluminum nitride, and that has good heat conductive property and insulating property may be used. As regards a thickness of the ceramic substrate, a thickness of about 0.5-1.0 mm is appropriate in order to reduce a thermal capacity, and the substrate is formed in a rectangular shape of about 10 mm in width and about 300 mm in length.

Part (b) of FIG. 6 is a schematic enlarged cross-sectional view of the heater 132. On one (front surface) of surfaces of the heater substrate 132*a*, a heat generating resistor 135 is formed along a longitudinal direction. The heat generating resistor 135 is formed of, as a main component, a silver-palladium alloy, a nickel-tin alloy, or ruthenium oxide alloy, and is formed in a thickness of about 10 mm and a width of about 1 to 5 mm by screen printing, or the like.

The front surface of the heater substrate 132*a*, on which the heat generating resistor 135 is formed, is overcoated with an insulating glass 136 as an electrical insulating layer. The insulating glass 136 has functions of not only ensuring an insulating property between the heat generating resistor 135 and an outer electroconductive member (the electroconductive layer of the film 133) but also preventing mechanical damage. As a thickness thereof, a thickness of about 20 to 100 μm is appropriate. The insulating glass 136 also has a function as a sliding layer sliding on the film 133.

(1-3) Guiding Member 131

The guiding member 131 is a member formed of a heat-resistant resin material, and not only supports the heater 132, but also functions as a feeding guide of the film 133. At a lower surface of the guiding member 131, a groove portion is formed along the longitudinal direction, and the heater 132 is engaged in the groove portion with a front surface outward and thus, the heater 132 is supported by the groove portion.

As a material of the guiding member 131, a high heat-resistant resin material, excellent in processing property, such as polyimide, polyamideimide, polyether ether ketone, polyphenylene sulfide, or a liquid crystal polymer, or a composite material of these resin materials with ceramics, metal, glass, or the like, may be used. In this embodiment, the liquid crystal polymer was used.

(1-4) Flange 139

The flanges 139(L,R) disposed at the end portions of the film 133 with respect to the longitudinal direction are mold products formed of the heat-resistant resin material in a bilaterally symmetrical shape. Parts (a), (b), and (c) of FIG. 7 are schematic views of the flange 139 as seen from an inner surface side, a side surface side, and a top surface side, respectively. Part (d) of FIG. 7 is a longitudinal sectional view of the flange 139. As shown in these figures, the flange 139 includes an inner periphery regulating portion (inner surface preventing member) 139*a*, an end portion preventing (regulating) portion 139*b*, a pressure-receiving portion 139*c*, an engaging portion 139*d* engageable with an outwardly projected portion 140*a* of the stay 140, and an engaging vertical groove portion 139*e* engageable with the device frame 160.

The inner periphery regulating portion (surface member) 139*a* includes a contact region (hereinafter, referred to as an inner surface regulating surface) 139*f* opposing an inner peripheral surface of the end portion of the film 133. The inner periphery regulating portion 139*a* regulates the end portion of the film 133 from an inside of the film 133, and thus performs a function of causing the film 133 to draw a desired rotation locus.

In this embodiment, as regards an outer shape of the inner periphery regulating portion 139*a*, a shape is formed such that a lower portion of a substantially true circle of 24.2 mm in diameter is cut away. As a result, the film 133 is hoisted compared with a natural rotation shape thereof, so that accommodation of many incorporated members, such as the thermistor 138 and the pressing rigid stay 140, in the film 133 is realized.

The end portion preventing portion 139*b* opposes a longitudinal end surface of the film 133, and performs a function of preventing longitudinal movement of the film 133 when the film 133 moves in the longitudinal direction. The end portion preventing portion 139*b* is provided outside the inner periphery regulating portion 139*a* with respect to the longitudinal direction of the film 133.

The pressure-receiving portion 139*c* directly contacts the pressing rigid stay 140 and performs a function of pressing down the pressing rigid stay 140 by a pressing spring 164(L,R) provided in a compressed state.

The flange 139(L,R) uses a glass fiber-containing resin material, such as PPS, liquid crystal polymer, PET, or PA, as a material that is excellent in heat-resistant property and a lubricating property and that is relatively poor in thermal conductivity, and in this embodiment, PPS is used. In this embodiment, the inner periphery regulating portion 139*a* and the end portion 139*b* are integrally molded with each other, but these portions may also be constituted by separate component parts.

(2) Pressing Roller 134

The pressing roller 134 as a second rotatable member (pressing member) forms the nip N between itself and the film 133 on the heater 132, and is a member for rotationally driving the film 133. The pressing roller 26 is an elastic roller that includes a metal core 134*a*, formed from a material such as SUS, SUM, or Al, and an elastic layer 134*b* formed on an outer peripheral surface of the metal core 134*a* by a heat resistant rubber, such as a silicone rubber or a fluorine-containing rubber, or by foaming the silicone rubber. As regards the pressing roller 134, on the elastic layer 134*b*, a parting layer 134*c* formed of PFA, PTFE, FEP, or the like, may also be formed. In this embodiment, the aluminum metal core 134*a* was used, and a 4.0 mm-thick silicone rubber was used as the elastic layer 134*b*. Further, a 50 μm-thick layer of PFA was used as the parting layer 134*c*.

The pressing roller 134 is rotatably provided so that one end side and the other end side of a shaft portion are shaft-supported via bearing members 162 between side plates 161L and 161R of the device frame 160 in one end side and the other end side, respectively. In the other end side of the shaft portion, a driving gear G1 is provided concentrically and integrally with the shaft portion. To this gear G1, a driving force of a motor M controlled by a controller (engine controller) 50 (FIG. 8) is transmitted through a drive transmitting portion (not shown), whereby the pressing roller 134 is rotationally driven as the rotatable driving member at a predetermined peripheral speed in an arrow R134 direction in FIG. 5.

The film unit 150 is provided between the side plates 161L and 161R of the device frame 160 while being disposed substantially parallel to the pressing roller 134 in a side on the pressing roller 134 with the heater 132 surface downward. The engaging vertical groove portions 139 of the flanges 139L and 139R of the film unit 150 engage with vertical edge portions of vertical guide slits 163 and 163 provided in the side plates 161L and 161R.

As a result, the flanges 139L and 139R are held slidably (movably) in a vertical (up-down) direction relative to the side plates 161L and 161R. That is, the film unit 150 has a degree of freedom such that the film unit 150 is movable as a whole in directions of moving toward and away from the pressing roller 134 along the vertical guide slits 163 and 163 between the side plates 161L and 161R.

(3) Pressing (Urging) Mechanism

Pressing levers 165L and 165R pressed (urged) by the pressing springs 164L and 164R, respectively, contact the pressure-receiving portions 139*c* of the flanges 139L and 139R, respectively. The pressing spring 164L is compressedly provided between a spring receiving portion 167L of a top plate 166 in one end side of the device frame 160 and the pressing lever 165L. The pressing spring 164R is compressedly provided between a spring receiving portion 167R of the top plate 166 in the other end side of the device frame 160 and the pressing lever 165R.

By compression reaction forces of the pressing springs 164L and 164R, predetermined equal urging forces act on the outwardly projected portions 140*a* and 140*a* of the stay 140 in one end side and the other end side of the film unit 150 via the flanges 139L and 139R, respectively.

As a result, the film 133 on the guiding member 131 including the heater 132 press-contacts the pressing roller 134, and more specifically, presses against the elastic layer 134*b* of the pressing roller 134 with a predetermined pressing force. In the fixing device 130 in this embodiment, the heater 132, or the heater 132 and a part of the guiding member 131 function as a sliding member (back-up member) contacting the inner surface of the film 133. For that reason, as shown in FIG. 5, the nip N having a predetermined width with respect to a sheet feeding direction a is formed between the film 133 and the pressing roller 134.

(4) Fixing Operation

As described above, the driving force of the motor M controlled by the controller 50 is transmitted to the gear G1 of the pressing roller 134 via the drive transmitting portion, so that the pressing roller 134 is rotationally driven as the rotatable driving member at the predetermined peripheral speed in the arrow R134 direction in FIG. 5. By this rotation of the pressing roller 134, based on a frictional force between the pressing roller 134 and the film 133 at the nip N, a rotational force acts on the film 133. As a result, the film 133 is rotated by the rotational force in an arrow R133 direction at a peripheral speed substantially corresponding to the rotational peripheral speed of the pressing roller 134 while being slid at an inner surface in close contact with the surface of the heater 132 and a part of the outer surface of the guiding member 131.

On the other hand, the heater 132 is supplied with electrical power from an energizing portion 51, controlled by the controller 50, through an unshown energizing path, and abruptly generates heat. A temperature of this heater 132 is detected by a thermistor 138 provided in contact with a back (rear) surface of the heater 20, and detected temperature information is inputted to the controller 50. The controller 50 properly controls a current caused to flow from the energizing portion 51 depending on the detected temperature information and increases the temperature of the heater 132 to a predetermined temperature, so that temperature control is carried out.

The thermistor 138 is an element for detecting the temperature of the heater 132 at a longitudinal central portion.

The temperature detected by the thermistor 138 is inputted to the controller 50. The thermistor 138 is an NTC (negative temperature coefficient) thermistor, so that a resistance value decreases with temperature rise. The temperature of the ceramic heater 132 is monitored by the controller 50 and is compared with a target temperature set inside the controller 50, so that the electrical power supplied to the heater 132 is adjusted. As a result, the electrical power supplied to the heater 132 is controlled so that the heater temperature is maintained at the target temperature.

Thus, in a state in which the pressing roller 134 is rotationally driven and the film 133 is driven with the rotational drive of the pressing roller 134 and then the heater 132 is increased in temperature to the predetermined temperature, the sheet S carrying the unfixed toner image T is introduced from the image forming portion 101 side to the nip N. The sheet S is introduced to the nip N so that a carrying surface of the unfixed toner image T faces the film 133, and is nipped and fed. As a result, the unfixed toner image T on the sheet S is fixed as a fixed image by being heated and pressed. The sheet S passes through the nip N, is curvature-separated from the surface of the film 25, and is fed and discharged from the fixing device 130. That is, the sheet S on which the toner image T is formed is heated while being fed through the nip N, with the result that the toner image T is fixed on the sheet S.

(5) Rotational Locus of the Film

Parts (a) and (b) of FIG. 9 are a schematic front view and a schematic sectional view, respectively, of the film 133 and the pressing roller 134 in the case in which the pressing roller 134 is rotationally driven without mounting the flanges 139 at both end portions of the film 133, i.e., without regulating the film end portions by the inner periphery regulating portions 139*a* of the flanges 139. The film 133 is rotated by receiving the driving force of the pressing roller 134 in the nip N.

The film 133 receives the force from the pressing roller 134 in the rotational direction in the nip N, but polyimide, as the base layer material of the film 133, is not strong in rigidity. For that reason, the film 133 travels, as shown in part (b) of FIG. 9, while maintaining an elliptical shape that is shortened with respect to a pressing direction.

On the other hand, in the case in which the flanges 139(L,R) including the inner periphery regulating portions 139*a* having the substantially true circle shape are mounted at the end portions of the film 133, the film 133 travels along a rotational locus shown in FIG. 10. As shown in part (a) of FIG. 10, showing a front view of the film 133, the rotational locus of the film 133 is different between a central portion and each of the end portions of the film 133 regulated by the flanges 139(L,R). Solid lines in parts (b) and (c) of FIG. 10 show rotational loci of the film 133 at a longitudinal central portion and a longitudinal end portion, respectively, of the film 133, and broken lines in parts (b) and (c) of FIG. 10 show rotational loci in the case in which the film 133 is not regulated by the flanges 139 (FIG. 9).

An inner periphery of each of the end portions of the film 133 is regulated by the inner periphery regulating portion 139*a* having the substantially true circle shape, and, therefore, the film 133 travels along a rotational locus having a shape close to the substantially true circle shape. On the other hand, at the central portion of the film 133, the inner periphery of the film 133 is not regulated, and, therefore, the film shape is somewhat close to an elliptical shape. Compared with the case in which the film end portions are regulated by the inner periphery regulating portions 139*a*, however, the film 133 rotates in a shape such that the film 133 is hoisted just above the inner periphery regulating portions 139*a*.

In the case in which the flanges 139(L,R) are mounted at the end portions of the film 133, the rotational locus is different between the longitudinal central portion and the longitudinal end portions, so that the film 133 flexes at the longitudinal central portion. In this case, the film 133 receives both of a "force for regulating the film shape in the substantially true circle shape" and a "force for shaping into a natural elliptical shape." Then, at an innermost point of the inner periphery regulating portion 139*a* of the flange 139, i.e., at an arrow portion J in FIG. 11, the film 133 and the flange 139 strongly rub against each other.

When the fixing device 130 is continuously used in this state, the inner peripheral surface of the film 133 and the inner surface regulating surface 139*f*, as a contact region of the inner periphery regulating portion 139*a* opposing the inner peripheral surface of the film 133, are liable to abrade or to deteriorate, and finally, the film end portion is torn and the film 133 becomes unusable.

Conventionally, in order to prevent this problem, as shown in FIG. 12, a rounded portion (R-portion) is provided at an innermost point of the inner periphery regulating portion 139*a*, to introduce a flange shape such that the film 133 and the flange 139 do not strongly rub against each other. In a case in which a small diameter of the film 133 and the substantially true circle shape of the inner periphery regulating portion 139*a* of the flange 139 are realized compatibly, however, even when such a constitution is employed, a sliding pressure increases at an arc starting portion from a flat surface portion of the inner surface regulating surface 139*f* indicated by an arrow K. In the case in which the film 133 rotates at a high speed, this phenomenon is promoted, and, therefore, has formed a bottleneck in speed-up and lifetime extension of the image forming apparatus.

In this embodiment, in order to solve this problem, an inclination angle of the inner surface regulating surface 139*f* of the inner periphery regulating portion 139*a* is optimized and details thereof will be described in the following item (6).

(6) Angle of Flange Inner Periphery Regulating Portion

As items relating to the sliding pressure between the inner peripheral surface of the film 133 and an innermost point J (FIG. 11) of the inner periphery regulating portion 139*a* of the flange 139, the following three items exists.

A first item is ease of flexure of the film 133. This item is capable of being changed due to various factors such as an inner diameter, a longitudinal dimension, a base layer material, and the presence or absence of the elastic layer of the film 133.

A second item is a shape of the inner periphery regulating portion 139*a*. From a viewpoint of low thermal capacity, or the like, a decrease of a diameter of the film 133 advances, and, on the other hand, the number of the incorporated members, such as many protective (safety) elements, of the film increases, so that the inner periphery regulating portion 139*a* has a shape, such as the substantially true circle shape, that is different from a natural elliptical shape of the film 133 in many cases.

These two items (factors) are determined in many cases by a required performance of the fixing device 130.

A third item is the inclination angle of the inner surface regulating surface 139*f* In this embodiment, optimization of this item is carried out, and details thereof will be described.

Figure 1:
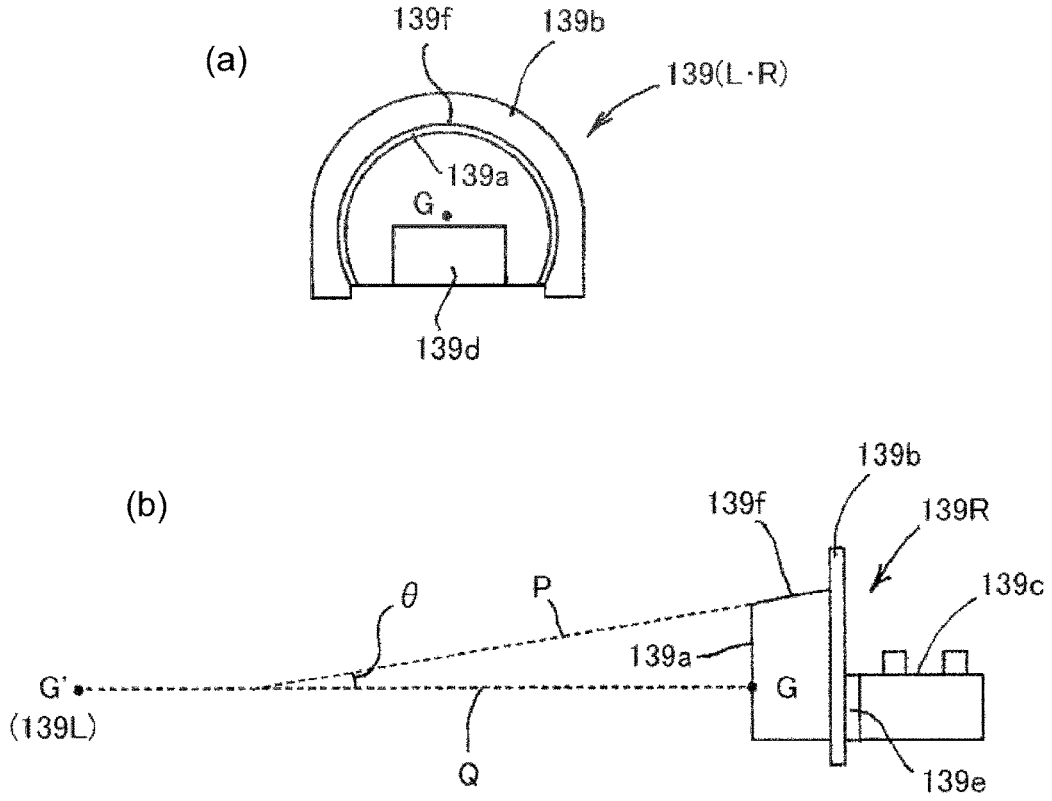

Part (a) of FIG. 1 is an inner surface view of the flange 139, and a point G shows the center of gravity with respect to the inner periphery regulating portion 139*a*. Part (b) of FIG. 1 is a side (surface) view of the flange 139R and shows the inclination angle of the inner surface regulating surface 139*f* of the inner periphery regulating portion 139*a*. In part (b) of FIG. 1, a line connecting the centers of gravity G and G' of the two flanges 139R and 139L, respectively at both end portions of the film 133 (i.e., a line connecting the centers of gravity of the inner periphery regulating portions 139*a* of the film end portions) is a generatrix Q.

An angle formed by the generatrix Q and a line P extended from the inner surface regulating surface 139*f* of the inner periphery regulating portion 139*a* is an angle θ, and this angle θ is defined as the inclination angle of the inner surface regulating surface 139*f* In many cases, the generatrix G is also parallel to lines of the centers of gravity (rotational axes or generatrices) of the film 133 and the pressing roller 134. Accordingly, the generatrix G can be defined as a generatrix of the film 133 that is a first rotatable member incorporated in the fixing device 130. That is, the inner surface regulating surface 139*f* is inclined so as to be spaced from the inner surface of the film 133 toward a longitudinal center of the film 133 with respect to the longitudinal direction of the film 133.

Depending on a value of the angle θ, a relationship between a degree of flexure of the film 133 and the inner periphery regulating portion 139*a* changes, and, therefore, a manner of the contact between the film inner peripheral surface of the inner surface regulating surface 139*f* changes. As shown in FIG. 11, in the case in which the inner surface regulating surface 139*f* is parallel to the generatrix G and in the case in which the angle θ is close to 0°, the film inner peripheral surface and the inner periphery regulating portion 139*a* strongly rub against each other at the innermost point J, and thus, lead to abrasion and deterioration of the film 133 and the inner periphery regulating portion 139*a*.

FIG. 13 shows a profile of the film inner surface in the case in which printing is carried out for 5 hours by using the flanges 139(L,R) including the inner surface regulating surface 139*f* having the inclination angle of 0.5°. In FIG. 13, the profile from the longitudinal central portion toward the longitudinal end portion of the film 133 is shown, and it is understood that the film inner surface is abraded at a portion (position) of 5 mm from the end portion (end) of the film 133. This shows that the film inner surface has been abraded at the innermost point J.

In this embodiment, as shown in FIG. 14, the degree of flexure of the film 133 and the inclination angle of the inner surface regulating surface 139*f* are caused to be close to each other. As a result, the inner periphery regulating portion 139*a* does not strongly rub against the film 133 at the innermost point J, so that the abrasion and deterioration of the film 133 and the flanges 139(L,R) were alleviated. The following description relates to experiments that were conducted for confirming these effects.

Experiment 1

The contact between the film 133 and the inner periphery regulating portion 139*a* when the inclination angle θ of the inner surface regulating surface 139*f* changed was checked. As regards an image forming apparatus main assembly, an image forming apparatus main assembly 100A, as described above, was used. As regards the fixing device 130, nine kinds of fixing devices with inclination angles θ between the inner surface regulating surfaces 139*f* of the flanges 139 ranging from 0° to 4° with an increment of 0.5° were prepared.

Then, in order to confirm the contact between the film 133 and the inner periphery regulating portion 139*a*, grease was applied onto the inner surface of the film 133. At a portion where the inner surface regulating surface 139*f* contacts the film 133, the grease deposits when the film 133 rotates, and, therefore, as shown in FIG. 15, a contact portion U can be observed.

Using each of the nine kinds of the fixing devices, printing for two minutes was carried out, and then grease-deposited regions were compared with each other after the end of the printing.

An experiment result was shown in Table 1, below, and in FIG. 16. In the case in which the angle θ of the inner periphery regulating portion 139*a* (the inner surface regulating surface 1390 is small, a length of the contact portion U is 5 mm, so that the film 133 contacts an entire region of the inner surface regulating surface 139*f* With an increasing angle θ, the angle of the inner surface regulating surface 139*f* is greater than the degree of flexure of the film 133, so that an inside of the inner surface regulating surface 139*f* gradually does not contact the film 133. In the cases in which the angle θ is 3° or more, the inner surface regulating surface 139*f* contacts the film 133 only in a region of ½ of the inner surface regulating surface 139*f*, so that an effect of hoisting (raising) the film 133 decreases, and, therefore, it can be said that this is undesirable from a viewpoint of ensuring a space of the incorporated members of the film 133.

TABLE 1

| Angle θ (° C.) | Contact portion length (mm) |
|---|---|
| 0 | 5.0 |
| 0.5 | 5.0 |
| 1.0 | 5.0 |
| 1.5 | 5.0 |
| 2.0 | 4.0 |
| 2.5 | 2.7 |
| 3.0 | 2.3 |
| 3.5 | 2.2 |

Experiment 2

An abrasion amount of the film inner surface when the angle θ of the inner surface regulating surface 139*f* was changed was checked. As regards the image forming apparatus main assembly and the fixing devices, those identical to those in Experiment 1 were prepared. Then, using the image forming apparatus main assembly 100A and each of the fixing devices, printing for about 100 hours was carried out, and then abrasion amounts of the film inner surfaces at the portion where each of the film inner surfaces slid on the inner surface regulating surface 139*f* were compared with each other.

An experiment result was shown in Table 2, below, and in FIG. 17. In the case in which the angle θ was close to 0°, the inner periphery regulating portion 139*a* strongly rubbed against the film inner surface at the innermost point, so that an entirety of the base layer having the thickness of 50 μm was completely abraded (worn). With an increasing angle θ, a degree of sliding (rubbing) of the inner periphery regulating portion 139*a* with the film inner surface at the innermost point J weakened, and in the case in which the angle θ was 2.0° or more, the inner periphery regulating portion 139*a* and the film 133 were in non-contact with each other at the innermost point J, so that the abrasion amounts became extremely small. As regards the abrasion amount of the film 133, it is desirable that the abrasion amount is suppressed to about 10 μm, and it is desirable that the inclination angle θ of the inner surface regulating surface 139*f* is 1.5° or more.

TABLE 2

| Angle θ (° C.) | Abrasion amount (μm) |
|---|---|
| 0 | 50 |
| 0.5 | 50 |
| 1.0 | 27.2 |
| 1.5 | 11.4 |
| 2.0 | 4.1 |
| 2.5 | 4.3 |
| 3.0 | 3.2 |
| 3.5 | 3.4 |

From the experiment, in the case in which the inclination angle θ of the inner surface regulating surface 139*f* is less than 1.5°, it is undesirable from a viewpoint of the abrasion of the film inner surface. In the case in which the inclination angle θ is greater than 3.0°, the effect of hoisting the film 133 decreases.

From the above result, as regards the problem of the abrasion of the film 133, the inclination angle θ of the inner surface regulating surface 139*f* may preferably be 1.5° or more. Further, when consideration is made including the effect of hoisting the film 133, the inclination angle θ of the inner surface regulating surface 139*f* may desirably be set between 1.5° and 3.0°.

The sliding between the film 133 and the flange 139 at the inner periphery regulating portion 139*a* of the flange 139 while hoisting the film 133 was described above. Now, the contact between the film 133 and the inner periphery regulating portion 139*a* of the flange 139 at a portion other than the film hoisting portion of the flange 139 will be described.

FIG. 18 is an inner surface view of the flange 139L(R), in which a region of the inner periphery regulating portion 139*a* is divided into three regions. In FIG. 18, the sheet S is fed through the nip N from a left(-hand) side to a right(-hand) side, and the left side is an upstream side and the right side is a downstream side.

An upstream end point of the inner periphery regulating portion 139*a* is point A. A downstream end point of the inner periphery regulating portion 139*a* is point B. A point, on the inner periphery regulating portion 139*a*, remotest from the nip N with respect to a sheet feeding direction a and a vertical direction is point C. Intersection points of the inner periphery regulating portion 139*a* and lines rotated about the center of gravity Gin the upstream side and in the downstream side by 45° from a rectilinear line connecting the point C and the point of the center of gravity G of the flange 139 are points D and E, respectively. In this figure (FIG. 18), a region between the points A and D is referred to as an upstream region (second region) X, a region between the points D and E is referred to as a top surface region (first region) Y, and a region between the points E and B is referred to as a downstream region Z. With respect to the rotational direction of the film 133, the upstream region X and the downstream region Z are closer to the nip N than the top surface region Y.

A broken line in FIG. 19 shows a rotational locus of the film 133 rotated by the pressing roller 134 using the flange 139 including the inner periphery regulating portion 139*a* having the substantially true circle shape. The film 133 receives a feeding force at the nip N from the pressing roller 134 in a direction toward the downstream side, and rotates in a state of deflection toward the downstream side. For this reason, the contact of the inner surface regulating surface 139*f* of the inner periphery regulating portion 139*a* with the film 133 is not always uniform at any portion. Specifically, in the upstream region X, the top surface region Y and the downstream region Z, a degree of the contact between the film 133 and the inner surface regulating surface 139*f* changes and, therefore, functions required for the respective regions are different from each other.

First, the contact between the film 133 and the inner surface regulating surface 139*a* in the top surface region Y is as described above. The inner periphery regulating portion 139*a* hoists the film 133, and, therefore, the film 133 and the inner surface regulating surface 139*f* strongly slide with each other. For that reason, by optimizing the inclination angle θ of the inner surface regulating surface 139*f*, there is a need to reduce the abrasion of the film 133 and the inner periphery regulating portion 139*a*.

Then, the contact between the film 133 and the inner surface regulating surface 139*f* in the downstream region Z will be described. As described above, the film 133 rotates in the state of deflection toward the downstream side, so that the film 133 and the inner surface regulating surface 139*f* are substantially in non-contact with each other. The inner periphery regulating portion part of the flange 139 on the downstream side has a function of regulating the film 133 in the case in which the film 133 is reversely rotated for jam clearance in the fixing device 130. For that reason, the sliding between the film 133 and the inner surface regulating surface 139*f* in the downstream region Z does not substantially generate.

Finally, the contact between the film 133 and the inner surface regulating surface 139*f* in the upstream region X will be described. As described above, the film 133 rotates in the state of deflection toward the downstream side, so that, in the upstream region X, the film 133 rotates while following the inner surface regulating surface 139*f* For that reason, also in the upstream region X, similarly as in the top surface region Y, the film 133 and the inner surface regulating surface 139*f* positively slide with each other. In the upstream region X, however, the inclination angle θ of the inner surface regulating surface 139*f* may preferably be close to 0°, and the reason therefor will be described below.

FIG. 20 is a schematic view of the film 133 and the flanges 139 as seen from the top surface side. Usually, a clearance a is provided between the film end portion and the end portion preventing (regulating) surface 139*b* of the flange 139L(R). This is because, in the case in which the length of the film 133 itself increases due to thermal expansion, or the like, the film 133 is prevented from stretching between the end portion preventing surfaces 139*b*. For that reason, during normal use, by the influence of the feeding of the sheet S, or the like, there is a possibility that the film 133 shifts toward either one of the flanges 139L and 139R.

FIG. 21 shows a state in which the film 133 shifts toward one end side in the case in which the length of the film 133 itself is short and the clearance between the film 133 and the end portion preventing surface 139*b* of the flange 139 is large. In FIG. 21, part (a) shows the case in which the inclination angle of the inner surface regulating surface 139*f* in the upstream region is small, and part (b) shows the case in which the inclination angle of the inner surface regulating surface 139*f* in the upstream region is large.

As described above, in the upstream region, the film 133 rotates while following the inner surface regulating surface

139*f* In the case in which the film 133 shifts toward one end side in a state in which the inclination angle of the inner surface regulating surface 139*f* in the upstream region is large (in the case of part (b) of FIG. 21), in a side opposite from the side where the film 133 shifts, the inner surface regulating surface 139*f* receives the film 133 at an inclined inside portion thereof. As a result, a regulating (preventing) state of the film 133 by the inner surface regulating surface 139*f* is different between left and right sides, so that the film 133 rotates in a state in which the film 133 obliquely inclines with respect to the rotational direction and the sheet feeding direction a of the pressing roller 134.

This state is not preferred from the following two points. A first point is stability of sheet feeding. With respect to the sheet feeding direction a, the film 133 rotates in the obliquely inclined state, and, therefore a force for obliquely feeding the sheet S acts on the film 133. As a result, this leads to inclination of the sheet S relative to the image and a problem of a feeding jam, or the like.

A second point is durability of the film 133. The film 133 is in the obliquely inclined state, and, therefore, a manner of abutment (contact) of the film 133 with the end portion preventing surface (portion) 139*b* changes. In the case in which the film 133 shifts in the obliquely inclined state, as shown in part (c) of FIG. 21, on the upstream side, a clearance 13 is formed between the film end surface and the end portion preventing surface 139*b*, and at a portion other than the upstream side portion, the film 133 strongly slides against the end portion preventing surface 139*b*. In this case, a sliding force stronger than that in the case where the film 133 abuts against the end portion preventing surface 139*b* at an entirety of full circumferential portion is exerted on the film 133, so that the durability of the film 133 is lowered.

From the above result, in the top surface region Y, the durability of the film 133 and the effect of hoisting the film 133 are compatibly achieved, and, therefore, a proper inclination angle of the inner surface regulating surface 139*f* exists. Specifically, it is desirable that the inclination angle of the inner surface regulating surface 139*f* in the top surface region Y is about 2° (2° or more). In the upstream region X, the inclination angle of the inner surface regulating surface 139*f* may preferably be small from viewpoints of the feeding stability of the sheet S and the durability of the film 133. Incidentally, in the upstream region X, the inclination angle of the inner surface regulating surface 139*f* may also be 0°, i.e., a distance between the inner surface regulating surface 139*f* and the inner surface of the film 133 is the same over the longitudinal direction of the film 133.

Specifically, the inclination angle of the inner surface regulating surface 139*f* in the upstream region X may desirably be about 0°. That is, the inclination angle of the inner surface regulating surface 139*f* in the top surface region Y may preferably be greater than the inclination angle of the inner surface regulating surface 139*f* in the upstream region X, and specifically, the inclination angle in the top region Y is made greater than the inclination angle in the upstream region X by 1° or more, whereby the lifetime of the film 133 can be extended with a simple constitution.

Further, in this embodiment, as regards the inner surface regulating surface 139*f*, a difference in contact of the film 133 with the inner surface regulating surface 139*f* between the upstream region X and the top surface region Y was described using a parameter that is the inclination angle, but a parameter that is a level difference of the inner surface regulating surface may also be used.

FIG. 22 is a schematic view showing a state of the flange 139R(L) in the case in which the inner surface regulating surface 139*f* is inclined in the top surface region X, and in which, as seen from a generatrix Q passing through the center of gravity G, a remotest point of the inner surface regulating surface 139*f* is point F and a closest point of the inner surface regulating surface 139*f* is point H. At this time, when a distance between the point F and the generatrix Q is f and a distance between the point H and the generatrix G is h, an index indicating the degree of inclination of the inner surface regulating surface 139*f* can be expressed by the level difference between the points F and H, i.e., f−h.

According to this embodiment, by providing a proper level difference in the top surface region Y, the durability of the film 133 and the effect of hoisting the film 133 can be compatibly realized. By minimizing the level difference in the upstream region X, the durability and the feeding stability of the film 133 can be compatibly realized. Specifically, in the case in which the length of the inner surface regulating surface 139*f* is 5 mm, the level difference of the inclination in the top surface region Y may desirably be 0.15 mm or more, and, by making the level difference in the top surface region Y greater than the level difference in the upstream region X by 0.08 mm, the lifetime of the film 133 can be extended with a simple constitution.

Further, in this embodiment, boundaries between the upstream region X and the top surface region Y and between the downstream region Z and the top surface region Y were set at the points D and E, respectively, that are provided in positions of 45° from the point C on the upstream side and on the downstream side, respectively. Depending on the shape of the inner surface regulating surface 139*f* of the flange 139, however, a degree of the contact of the inner surface regulating surface 139*f* with the film 133 changes, and, therefore, the positions of the boundaries may also be changed depending on the degree of the contact.

The constitution of the above-described inner periphery regulating portion (inner surface regulating member) 139*a* is summarized as follows. The inner surface regulating surface (contact region) 139*f* of the inner periphery regulating portion 139*a* has the inclination with respect to the generatrix G of the film 133 so as to decrease in outer diameter toward the longitudinal inside portion of the film (first rotatable member) 133. Further, the degree of the inclination in the top surface region Y including the remotest point C from the nip N with respect to the circumferential direction of the contact region is greater than the degree of the inclination in the upstream region X between the top surface region Y and the upstream end point A, along the circumferential direction of the contact region, with respect to the sheet feeding direction a.

The inclination of the inner surface regulating surface 139*f* is the level difference (f−h) between the highest portion F and a lower portion H of the inner surface regulating surface 139*f*, and the level difference in the top surface region Y is greater than the level difference in the upstream region X. The level difference in the top surface region Y is 0.15 mm or more. The difference between the level difference in the top surface region Y and the level difference in the upstream region X is 0.08 mm or more.

Embodiment 2

In Embodiment 1, the inclination was provided in the top surface region Y of the inner surface regulating surface 139*f*, and the local sliding between the film 133 and the inner surface regulating surface 139*f* was prevented, so that the lifetime extension of the film 133 was realized. By providing the inclination on the inner surface regulating surface 139*f*, however, the effect of hoisting the film 133 was lowered not a little, so that it became difficult to further increase the number of the incorporated members in some cases.

In this embodiment (Embodiment 2), further compatibility of the durability of the film 133 and the effect of hoisting the film 133 is realized by optimizing the shape of the inner surface regulating surface 139*f* of the flange 139 in the top surface region Y. Basic constitutions of the image forming apparatus 100 and the fixing device 130 in this embodiment are similar to those in Embodiment 1. Constituent members identical to those in Embodiment 1 are represented by the same reference numerals or symbols and will be omitted from description.

Parts (a) and (b) of FIG. 23 are schematic views of the film 133 and the flange 139 as seen from the front surface (side). Part (a) of FIG. 23 shows the case in which the inner surface regulating surface 139*f* of the flange 139 is not provided with an inclination, and, in this case, as described with reference to FIG. 11, the abrasion of the film inner surface of the inner periphery regulating portion 139*a* at the innermost point J is problematic. Part (b) of FIG. 23 shows a state in which the inner surface regulating surface 139*a* is provided with an inclination as described in Embodiment 1 (FIG. 14), and, although the film inner surface abrasion is suppressed, the effect of hoisting the film 133 is decreased compared with that in the case of part (a) of FIG. 23.

In such a background, the flange 139 in this embodiment is not provided with the inclination at an outside portion close to the end portion of the inner surface regulating surface 139*f*, so that the film hoisting effect as in the conventional constitution is obtained. At an inside portion of the inner surface regulating surface 139*f*, a predetermined inclination is provided, so that the inner surface abrasion of the film 133 is suppressed.

FIG. 24 shows a level difference of the inner surface regulating surface 139*f* in the case in which an inclination with an angle of 2.5° is provided in an entire region of 5 mm in length of the inner surface regulating surface 139*f* In the case in which the inclination is provided, an inside end lowers by about 175 μm compared with the case in which no inclination is provided, and correspondingly, the effect of hoisting the film 133 is decreased.

Parts (a) and (b) of FIG. 25 are schematic views showing an example of the flange 139 in this embodiment. A length region of 5 mm of the inner surface regulating surface 139*f* is constituted by an inclined region V1 in which the inclination with the angle of 2.0° is provided at an inside portion of 1 mm from the inside end and by an arcuate region V2 in which the inner surface regulating surface 139*f* extends from the inclined region V1 with a large arc of R=300.

First, from a view point of the effect of hoisting the film 133, the level difference of the inner surface regulating surface 139*f* of the flange 139 is 47 μm, and, therefore, it can be said that this effect is greater than that in the case in which the inner surface regulating surface 139*f* is provided with the inclination in the entire region (part (b) of FIG. 23 and FIG. 24). Here, the level difference of the inner surface regulating surface 139*f* changes depending on a position of the inclined region V1 provided in the length region of 5 mm of the inner surface regulating surface 139*f*.

Table 3, below, shows the length of the inclined region V1 and the level difference of the inner surface regulating surface 139*f* As the length of the inclined region V1 increases, the level difference of the inner surface regulating surface 139*f* becomes large, and, therefore, the effect of hoisting the film 133 lowers.

TABLE 3

| Length θ (° C.) | Level difference (μm) |
|---|---|
| 1 | 47 |
| 2 | 79 |
| 3 | 111 |
| 4 | 143 |
| 5 | 175 |

Next, from a viewpoint that the film inner surface is abraded at the innermost point J of the inner surface regulating surface 139*f* of the flange 139, the inclined region V1 is provided, such that the inner surface regulating surface 139*f* has the inclination angle of 2.0°, and, therefore, this constitution is advantageous compared with the constitution in which no inclination is provided on the inner surface regulating surface 139*f* (part (a) of FIG. 23). On the other hand, in the case in which an angle abruptly changes at a connecting portion W between the inclined region V1 and the arcuate region V2, the film inner surface is abraded at this point W in some cases.

As regards the abrasion of the film inner surface at the connecting portion W, the following two factors exist. A first factor is the shape of a region outside the inclined region V1. FIG. 26 is a schematic view showing a flange in the case in which an inside inclined region V1 and an outside rectilinear region V2 with the inclination angle of 0° are connected by an arcuate region V3 with a small R (radius). In this case, the R of the arcuate region V3 is small, and, therefore, the inner surface abrasion of the film 133 is promoted at the connecting portion W. In this embodiment, the outside region V2 (FIG. 25) is constituted by the large arc of R=300 in an entire region thereof, so that a change in angle of the connecting portion W is decreased.

A second factor is a width of the inclined region V1. The connecting portion W with the outside region V2 moves toward the inside with a narrower width and moves toward the outside with a broader width. Depending on a positional relationship between the flexed portion of the film 133 and the connecting portion W, a degree of the contact between the film 133 and the inner surface regulating surface 139*f* changes, so that a state of the inner surface abrasion of the film 133 changes. In this case, with a narrower inclined region V1, the connecting portion W approaches the case in which no inclination is provided on the inner surface regulating surface 139*f*, so that the inner surface of the film 133 is liable to abrade.

In this embodiment, the outside region V2 was connected by the arcuate (shape) portion, and the inclined region V1 was narrowed to the extent that the inner surface abrasion of the film 133 did not generate, so that the effect of hoisting the film 133 was increased.

The following description relates to experiments that were conducted for confirming these effects.

Experiment 3

An abrasion amount of the film inner surface when the length of the inclined region V1 of the inner surface regulating surface 139*f* changed was checked. As regards an image forming apparatus main assembly, an image forming apparatus main assembly 100A, as described with respect to Embodiment 1, was used. As regards the fixing device 130, nine kinds of fixing devices in which the inner surface regulating surfaces 139*f* had the angle of 2.5° in the inclined regions V1 and had lengths, of the inclined regions V1, changing from 0 mm to 4 mm with an increment of 0.5 mm were prepared.

Then, using the image forming apparatus main assembly 100A and each of the fixing devices, printing for 100 hours was carried out, and then, the abrasion amount of the film inner surface at a portion sliding on the flange 139 at that time was checked.

TABLE 4

| Length θ (° C.) | Abrasion amount (mm) |
|---|---|
| 0.5 | 36 |
| 1.0 | 19 |
| 1.5 | 12 |
| 2.0 | 10.2 |
| 2.5 | 5.3 |
| 3.0 | 3.1 |
| 3.5 | 3.5 |
| 4.0 | 3.3 |

An experiment result was shown in Table 4 and in FIG. 27. As the length of the inclined region V1 increased, the connecting portion W moved toward the outside of the inner surface regulating surface 139*f*, and the degree of the sliding with the film inner surface weakened, and, therefore, the abrasion amount decreased. The abrasion amount of the film inner surface may desirably be up to about 10 μm, so that the length of the inclined region V1 of the inner surface regulating surface 139*f* may desirably be 2.0 mm or more. At this time, the level difference of the inner surface regulating surface 139*f* was 79 μm, so that the level difference was able to be made less than the level difference of 175 μm in Embodiment 1.

From the above result, by using the flange 139 having the shape such that the inclination is provided in the inside region V1 of the inner surface regulating surface 139*f* and the arcuate connecting portion is provided in the outside region V2, the durability of the film 133 can be enhanced while decreasing the level difference of the inner surface regulating surface 139*f* compared with that in the conventional constitution. Further, it is confirmed that a similar effect is also obtained in the case in which the inside region V1 is connected by an arcuate shape portion so as to form a shape close to the shape of the inner surface regulating surface 139*f* in this embodiment (Embodiment 2).

Thus, by providing the inclination on the inner surface regulating surface 139*f* hoisting the film 133, the sliding pressure between the film 133 and the inner surface regulating surface 139*f* becomes uniform and the abrasion speed of the film inner surface becomes slow. The degree of the inclination is decreased on the upstream side of the inner surface regulating surface 139*f*, so that the film 133 is prevented from obliquely rotating, and thus, stable sheet feeding becomes possible. By employing such a constitution, the lifetime of the film 133 can be extended with a simple constitution.

Other Embodiments

Proper ranges of the inclination angle θ, the level difference, and the length of the inclined region V1 of the inner surface regulating surface 139*f* of the flange in Embodiments 1 and 2 vary depending on a material, a thickness, and the like, of the film 133. In Embodiments 1 and 2, by employing the above-described features (constitutions), an effect such that the abrasion due to the sliding with the flange 139 can be suppressed is achieved even when any kind of the film is used. In this constitution, the inner surface regulating surface 139*f* of the flange 139 is inclined so as to be spaced from the film inner surface toward the longitudinal center of the film 133 with respect to the longitudinal direction of the film 133, and the inclination angle θ is greater in the top surface region Y than in the upstream region X or in the downstream region Z of the inner surface regulating surface 139*f*

(1) The pressing constitution, of the film unit 150 and the pressing roller 134, for forming the nip N can also be changed to a device constitution for pressing the pressing roller 134 against the film unit 150. A device constitution for pressing the film unit 150 and the pressing roller 134 against each other can also be employed. That is, the pressing constitution may only be required to employ a constitution in which at least one of the film unit 150 and the pressing roller 134 toward the other.

(2) The sliding member (back-up member) provided inside the film 133 may also be a member other than the heater 132.

(3) The heating means for heating the film 133 is not limited to the heater 132. It is possible to employ appropriate heating constitutions, using other heating means such as a halogen heater and electromagnetic induction coil, such as an internal heating constitution, an external heating constitution, a contact heating constitution and a non-contact heating constitution.

(4) In this embodiment, as the image heating apparatus, the fixing device for fixing the unfixed toner image formed on the recording material through heating was described as an example, but the present invention is not limited thereto. The present invention is also applicable to a device (glossiness improving device) for improving glossing (glossiness) of an image by reheating a toner image fixed or temporarily fixed on the recording material.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A fixing device comprising:

a rotatable cylindrical film;

a contact member contacting an inner surface of said film;

a nip forming member configured to form a nip in cooperation with said contact member through said film, wherein, in the nip, a recording material on which an image is formed is heated while being fed, and the image is fixed on the recording material; and a regulating member provided at an inner space of an end portion of said film in a longitudinal direction of said film, and including an inner surface regulating surface that contacts the inner surface of said film and that is configured to regulate a position of the inner surface of said film, wherein, as viewed in the longitudinal direction of said film, with respect to a rotational direction of said film, said inner surface regulating surface includes a first region remotest from the nip and a second region closer to the nip than the first region, and the second region being positioned in a side upstream of a center of the nip with respect to a recording material feeding direction, wherein said inner surface regulating surface is inclined so as to be spaced from the inner surface of said film toward a longitudinal center of said film with respect to the longitudinal direction of said film, and a degree of inclination of said inner surface regulating surface is greater in the first region than in the second region.

2. A fixing device according to claim 1, wherein said regulating member includes an end portion preventing surface configured to prevent movement of said film in the longitudinal direction, and in contact with a longitudinal end surface of said film when said film moves in the longitudinal direction of said film, and wherein said end portion preventing surface is provided outside said inner surface regulating surface with respect to the longitudinal direction of said film.

3. A fixing device according to claim 1, wherein, with respect to the longitudinal direction of said film, an inclination angle of said inner surface regulating surface in the first region is 1.5 degrees or more.

4. A fixing device according to claim 1, wherein said nip forming member is a heater.

5. A fixing device comprising:

a rotatable cylindrical film;

a contact member contacting an inner surface of said film;

a nip forming member configured to form a nip in cooperation with said contact member through said film, wherein, in the nip, a recording material on which an image is formed is heated while being fed, and the image is fixed on the recording material; and a regulating member provided at an inner space of an end portion of said film in a longitudinal direction of said film, and including an inner surface regulating surface that contacts the inner surface of said film and that is configured to regulate a position of the inner surface of said film, wherein, as viewed in the longitudinal direction of said film, with respect to a rotational direction of said film, said inner surface regulating surface includes a first region remotest from the nip and a second region closer to the nip than the first region, and the second region being positioned in a side upstream of a center of the nip with respect to a recording material feeding direction, wherein the first region of said inner surface regulating surface is inclined so as to be spaced from the inner surface of said film toward a longitudinal center of said film with respect to the longitudinal direction of said film, and, in the second region of said inner surface regulating surface, a distance from the inner surface of said film is the same over the longitudinal direction of said film.

6. A fixing device according to claim 1, wherein, as viewed in the longitudinal direction of said film, intersection points of said inner surface regulating surface and lines rotated about a center of gravity G of said inner surface regulating surface in the upstream side and in the downstream side by 45° from a rectilinear line connecting the point C that is remotest point from the nip and the center of gravity G are points D and E, respectively, and wherein a region between the points D and E is the first region.

7. A fixing device according to claim 5, wherein, as viewed in a longitudinal direction of said film, intersection points of said inner surface regulating surface and lines rotated about a center of gravity G of said inner surface regulating surface in the upstream side and in the downstream side by 45° from a rectilinear line connecting the point C that is remotest point from the nip and the center of gravity G are points D and E, respectively, and wherein a region between the points D and E is the first region.

8. A fixing device according to claim 5, wherein said regulating member includes an end portion preventing surface configured to prevent movement of said film in the longitudinal direction, and in contact with a longitudinal end surface of said film when said film moves in the longitudinal direction of said film, and wherein said end portion preventing surface is provided outside of said inner surface regulating surface with respect to the longitudinal direction of said film.

9. A fixing device according to claim 5, wherein, with respect to the longitudinal direction of said film, an inclination angle of said inner surface regulating surface in the first region is 1.5 degrees or more.

10. A fixing device according to claim 5, wherein said nip forming member is a heater.

11. A fixing device comprising:

a rotatable cylindrical film;

a contact member contacting an inner surface of said film;

a nip forming member configured to form a nip in cooperation with said contact member through said film, wherein, in the nip, a recording material on which an image is formed is heated while being fed, and the image is fixed on the recording material; and a regulating member provided at an inner space of an end portion of said film in a longitudinal direction of said film, and including an inner surface regulating surface that contacts the inner surface of said film and that is configured to regulate a position of the inner surface of said film, wherein, as viewed in the longitudinal direction of said film, with respect to a rotational direction of said film, said inner surface regulating surface includes a first region remotest from the nip and a second region closer to the nip than the first region, and the second region being positioned in a side upstream of a center of the nip with respect to a recording material feeding direction, wherein the first region of said inner surface regulating surface is inclined so as to be spaced from the inner surface of said film toward a longitudinal center of said film with respect to the longitudinal direction of said film, and the second region of said inner surface regulating surface is not inclined.

12. A fixing device according to claim 11, wherein, as viewed in a longitudinal direction of said film, intersection points of said inner surface regulating surface and lines rotated about a center of gravity G of said inner surface regulating surface in the upstream side and in the downstream side by 45° from a rectilinear line connecting the point C that is remotest point from the nip and the center of gravity G are points D and E, respectively, and wherein a region between the points D and E is the first region.

13. A fixing device according to claim 11, wherein said regulating member includes an end portion preventing surface configured to prevent movement of said film in the longitudinal direction, and in contact with a longitudinal end surface of said film when said film moves in the longitudinal direction of said film, and wherein said end portion preventing surface is provided outside said inner surface regulating surface with respect to the longitudinal direction of said film.

14. A fixing device according to claim 11, wherein, with respect to the longitudinal direction of said film, an inclination angle of said inner surface regulating surface in the first region is 1.5 degrees or more.

15. A fixing device according to claim 11, wherein said nip forming member is a heater.

* * * * *